US011211689B2

(12) United States Patent
Jung et al.

(10) Patent No.: US 11,211,689 B2
(45) Date of Patent: Dec. 28, 2021

(54) CHIP ANTENNA

(71) Applicant: Samsung Electro-Mechanics Co., Ltd., Suwon-si (KR)

(72) Inventors: Ji Hyung Jung, Suwon-si (KR); Sung Yong An, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 27 days.

(21) Appl. No.: 16/738,297

(22) Filed: Jan. 9, 2020

(65) Prior Publication Data

US 2021/0050651 A1 Feb. 18, 2021

(30) Foreign Application Priority Data

Aug. 13, 2019 (KR) ..... 10-2019-0098493

(51) Int. Cl.
*H01Q 1/48* (2006.01)
*H01Q 1/22* (2006.01)
(Continued)

(52) U.S. Cl.
CPC ..... *H01Q 1/2283* (2013.01); *H01Q 1/38* (2013.01); *H01Q 9/0414* (2013.01); *H01Q 9/0421* (2013.01)

(58) Field of Classification Search
CPC ..... H01Q 1/2283; H01Q 1/38; H01Q 9/0414; H01Q 9/0421; H01Q 9/04; H01Q 21/06;
(Continued)

(56) References Cited

U.S. PATENT DOCUMENTS 8,298,941 B2 * 10/2012 Yamaguchi ..... H01L 24/11 438/667
2009/0058731 A1 3/2009 Geary et al.
(Continued)

FOREIGN PATENT DOCUMENTS

JP 2003-283239 A 10/2003
JP 2011-171567 A 9/2011
(Continued)

OTHER PUBLICATIONS

Korean Office Action dated Sep. 14, 2020 in the counterpart of Korean Patent Application No. 10-2019-0098493 (6 pages in English, 5 pages in Korean).
(Continued)

*Primary Examiner* — Thien M Le
(74) *Attorney, Agent, or Firm* — NSIP Law

(57) ABSTRACT

A chip antenna includes a first ceramic substrate, a second ceramic substrate, a first patch antenna, a second patch antenna, and a feed via. The second ceramic substrate is disposed to oppose the first ceramic substrate. The first patch antenna includes a seed layer, disposed on a surface of the first ceramic substrate, and a plating layer disposed on the seed layer. The second patch antenna disposed on the second ceramic substrate. The feed via includes a seed layer, formed along an internal wall of a via hole penetrating through the first ceramic substrate in a thickness direction, and a conductive material surrounded by the seed layer in the via hole. The seed layer of the first patch antenna and the seed layer of the feed via are connected to each other.

24 Claims, 15 Drawing Sheets

1

(51) Int. Cl.
*H01Q 9/04* (2006.01)
*H01Q 1/38* (2006.01)

(58) Field of Classification Search
CPC ..... H01Q 13/08; H01Q 19/30; H01Q 1/243; H01Q 1/40; H01Q 21/08; H01Q 25/00
USPC ..... 343/846, 700, 720, 824, 847, 848, 879
See application file for complete search history.

(56) References Cited

U.S. PATENT DOCUMENTS

| | | | |
|---|---|---|---|
| 2011/0122041 | A1 | 5/2011 | Morishita et al. |
| 2011/0207322 | A1 | 8/2011 | Yamaguchi |

FOREIGN PATENT DOCUMENTS

| | | | |
|---|---|---|---|
| JP | 2018-137737 | A | 8/2018 |
| KR | 10-1163419 | B1 | 7/2012 |
| KR | 10-2018-0113050 | A | 10/2018 |
| WO | WO 2010/013610 | A1 | 2/2010 |

OTHER PUBLICATIONS

Korean Office Action dated Mar. 3, 2020 in corresponding Korean Patent Application No. 10-2019-0098493 (5 pages in English, 5 pages in Korean).

* cited by examiner

CHIP ANTENNA

CROSS-REFERENCE TO RELATED APPLICATION(S)

This application claims the benefit under 35 USC 119(a) of Korean Patent Application No. 10-2019-0098493 filed on Aug. 13, 2019 in the Korean Intellectual Property Office, the entire disclosure of which is incorporated herein by reference for all purposes.

BACKGROUND

1. Field

The present disclosure relates to a chip antenna.

2. Description of Related Art 5G communication systems are implemented in higher frequency (mmWave) bands, such as 10 GHz to 100 GHz bands, to achieve higher data transfer rates. To reduce the propagation loss of an RF signal and increase a transmission distance, beamforming, large-scale multiple-input multiple-output (MIMO), full dimensional multiple-input multiple-output (MIMO), array antennas, analog beamforming, and large-scale antenna techniques are being discussed for use in 5G communication systems.

In mobile communication terminals such as mobile phones, PDAs, navigation, laptop computers, supporting wireless communications, a trend of adding functions such as code division multiple access (CDMA), wireless LAN, DMB, near field communication (NFC), has developed, and one important component enabling these functions is the antenna.

However, in the GHz band to which the 5G communication system is applied, because a wavelength is reduced to several mm, it is difficult to use a conventional antenna. Accordingly, there is demand for a chip antenna module suitable for the GHz band while having an ultra-small size that could be mounted in a mobile communication terminal.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna includes a first ceramic substrate, a second ceramic substrate, a first patch antenna, a second patch antenna, and a feed via. The second ceramic substrate is disposed to oppose the first ceramic substrate. The first patch antenna includes a seed layer, disposed on a surface of the first ceramic substrate, and a plating layer disposed on the seed layer. The second patch antenna disposed on the second ceramic substrate. The feed via includes a seed layer, formed along an internal wall of a via hole penetrating through the first ceramic substrate in a thickness direction, and a conductive material surrounded by the seed layer in the via hole. The seed layer of the first patch antenna and the seed layer of the feed via are connected to each other.

The conductive material may penetrate through the seed layer of the first patch antenna, and may be connected to the plating layer of the first patch antenna.

The seed layer of the first patch antenna and the seed layer of the feed via may be formed of a same material.

Each of the seed layer of the first patch antenna and the seed layer of the feed via may be formed of any one or any combination of any two or more of Ti, Mo, and Cu.

The plating layer of the first patch antenna may be formed of any one or any combination of any two or more of Cu, Ni, and Sn.

The chip antenna may further include a feed pad including a seed layer formed on another surface of the first ceramic substrate and a plating layer formed on the seed layer.

The seed layer of the feed pad and the seed layer of the feed via may be connected to each other.

The conductive material may penetrate through the seed layer of the feed pad, and may be connected to the plating layer of the feed pad.

A thickness of the seed layer of the first patch antenna disposed on the surface of the first ceramic substrate may be equal to a thickness of the seed layer of the feed via formed on the internal wall of the via hole.

In another general aspect, a chip antenna includes a first ceramic substrate, a second ceramic substrate disposed to oppose the first ceramic substrate, a first patch antenna, a second patch antenna, and a feed via. The first patch antenna includes a seed layer, disposed on a surface of the first ceramic substrate, and a plating layer disposed on the seed layer. The second patch antenna is disposed on the second ceramic substrate. The feed via includes a conductive material, disposed in a central region of a via hole penetrating through the first ceramic substrate in a thickness direction, and a seed layer, disposed in an edge region of the via hole, connected to the conductive material. The conductive material is connected to the seed layer of the first patch antenna and the plating layer of the first patch antenna.

The seed layer of the first patch antenna and the seed layer of the feed via may be formed of a same material.

Each of the seed layer of the first patch antenna and the seed layer of the feed via may be formed of any one or any combination of any two or more of Ti, Mo, and Cu.

The plating layer of the first patch antenna may be formed of any one or any combination of any two or more of Cu, Ni, and Sn.

A feed pad including a seed layer may be formed on another surface of the first ceramic substrate and a plating layer formed on the seed layer.

The conductive material may be connected to the seed layer of the feed pad and the plating layer of the feed pad.

A thickness of the seed layer of the first patch antenna provided on the surface of the first ceramic substrate may be equal to a thickness of the seed layer of the feed via formed on an internal wall of the via hole.

In another general aspect, a chip antenna includes a first ceramic substrate having a first patch antenna disposed thereon, a second ceramic substrate, a feed via, and a seed layer. The second ceramic substrate, disposed on and spaced apart from the first ceramic substrate, has a second patch antenna disposed thereon. The feed via includes a conductive material disposed in a via hole penetrating through the first ceramic substrate in a thickness direction. The seed layer is disposed between surfaces of the first ceramic substrate and the first patch antenna, and surfaces of the first ceramic substrate and the conductive material.

The seed layer may be formed along an internal wall of the via hole.

The first patch antenna and the second patch antenna may each include a plating layer disposed on the seed layer.

The conductive material may penetrate through the seed layer between the first patch antenna and first ceramic substrate, and may be connected to the plating layer of the first patch antenna.

The second ceramic substrate may be spaced apart from the first ceramic substrate by a bonding layer.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
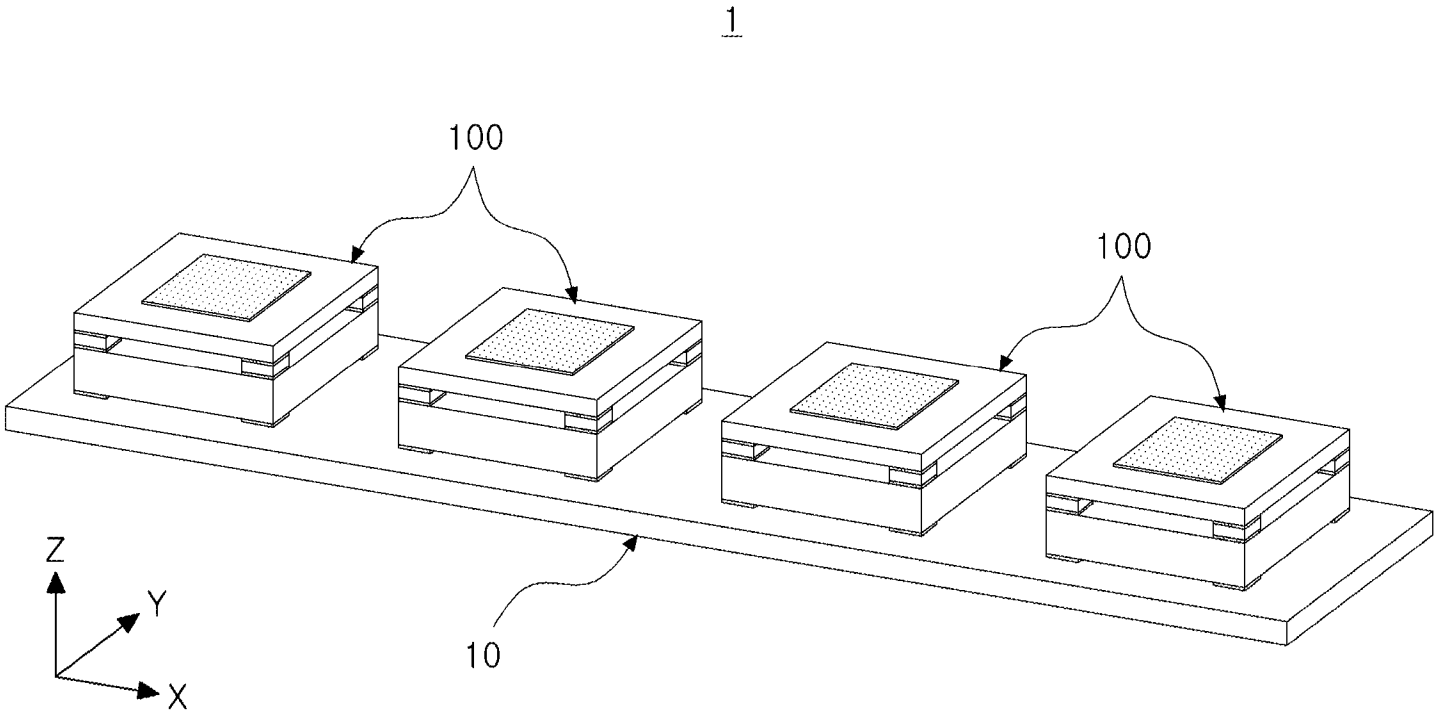
FIG. 1 is a perspective view of an example of a chip antenna module.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The chip antenna module described in the present specification is operated in a high frequency region and, for example, may be operated in a frequency band of 3 GHz or more. In addition, the chip antenna module described herein may be mounted on an electronic device configured to receive or transmit an RF signal. As an example, the chip antenna may be mounted on a mobile phone, a portable laptop computer, a drone, and or like.

One aspect of the present disclosure is to provide a chip antenna capable of strengthening adhesion between a ceramic substrate and a patch, and the like, and improving conduction characteristics of a feed via.

Figure 2A:
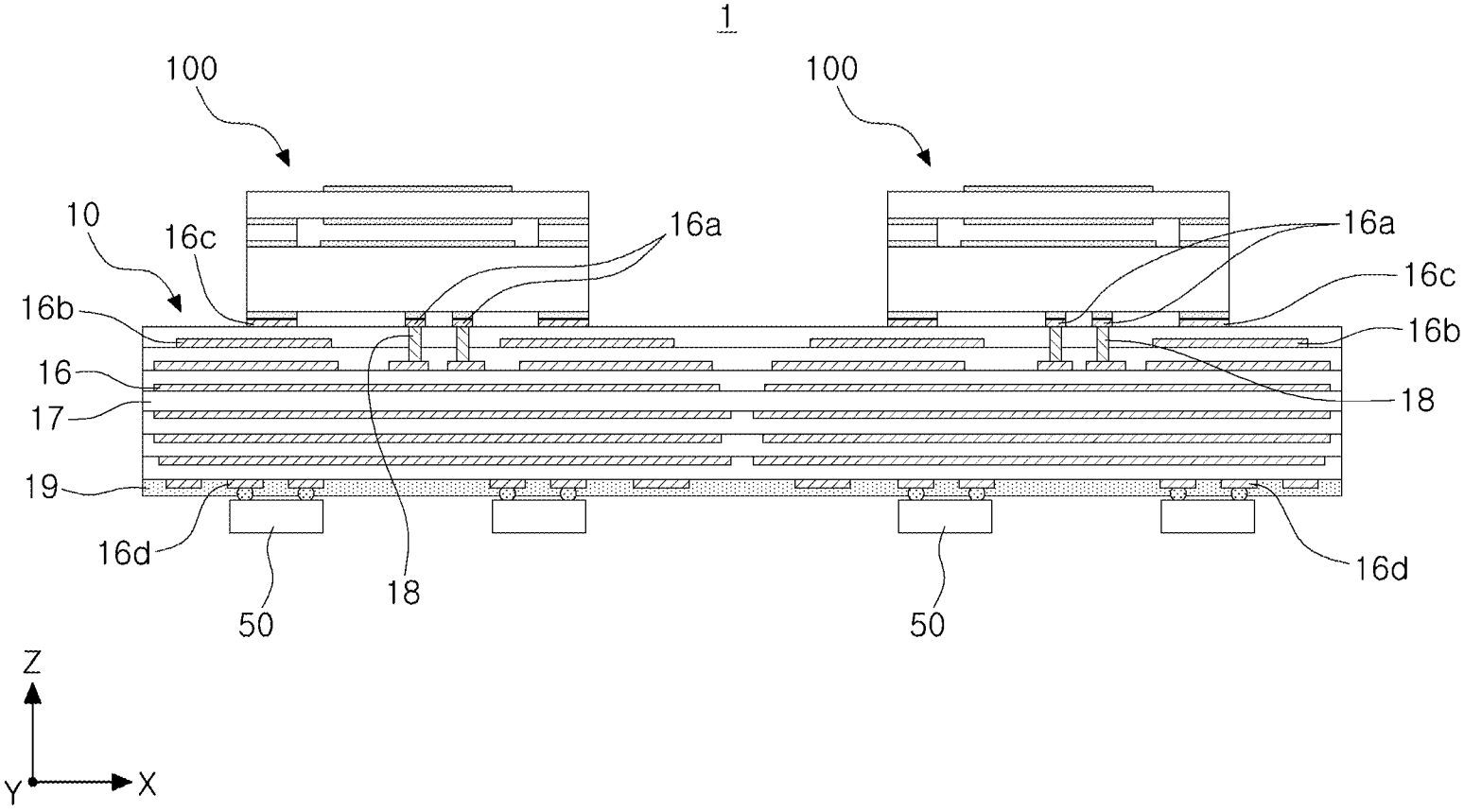
FIG. 2A is a cross-sectional view of a portion of the chip antenna module of FIG. 1.
Figure 3A:
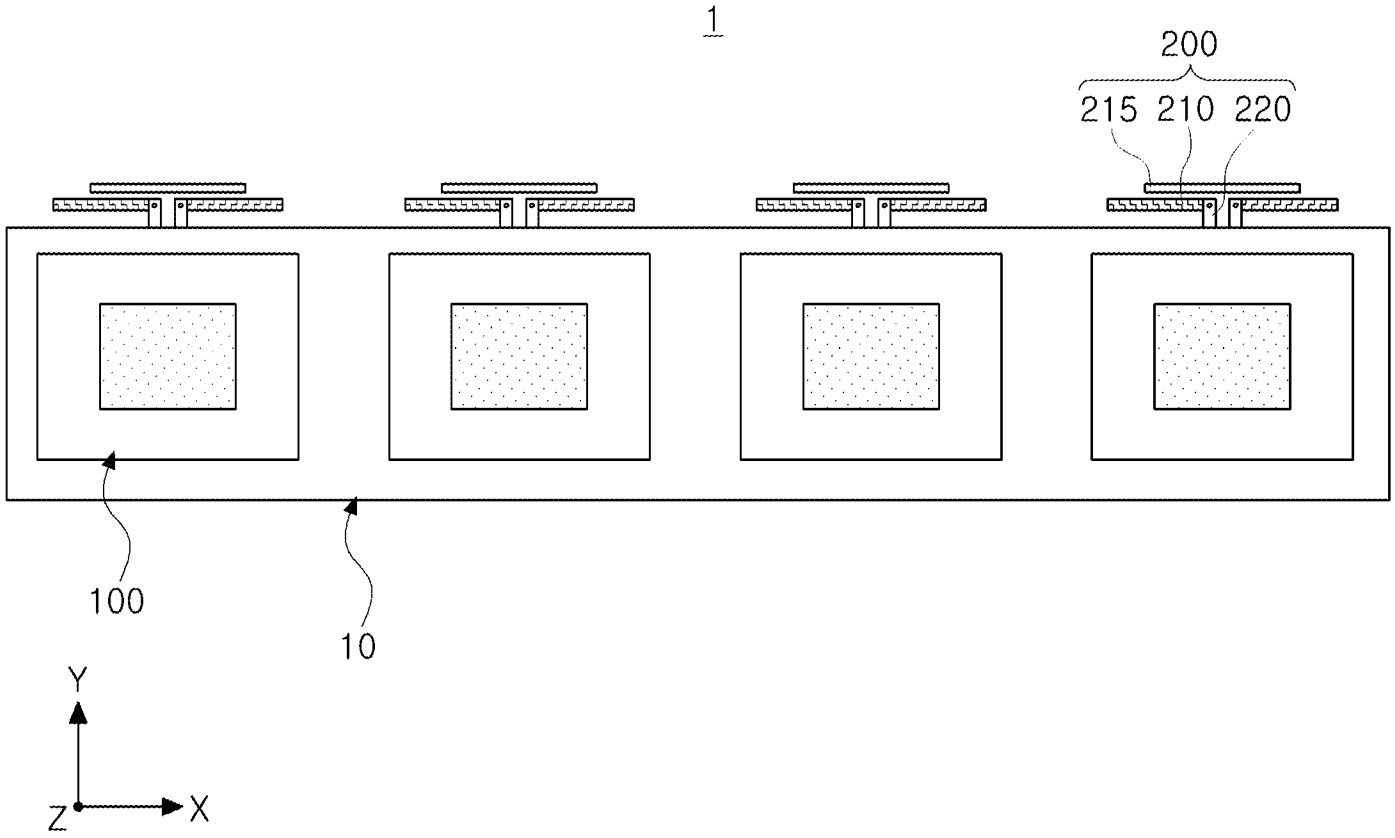
FIG. 3A is a plan view of the chip antenna module of FIG. 1.
Figure 3B:
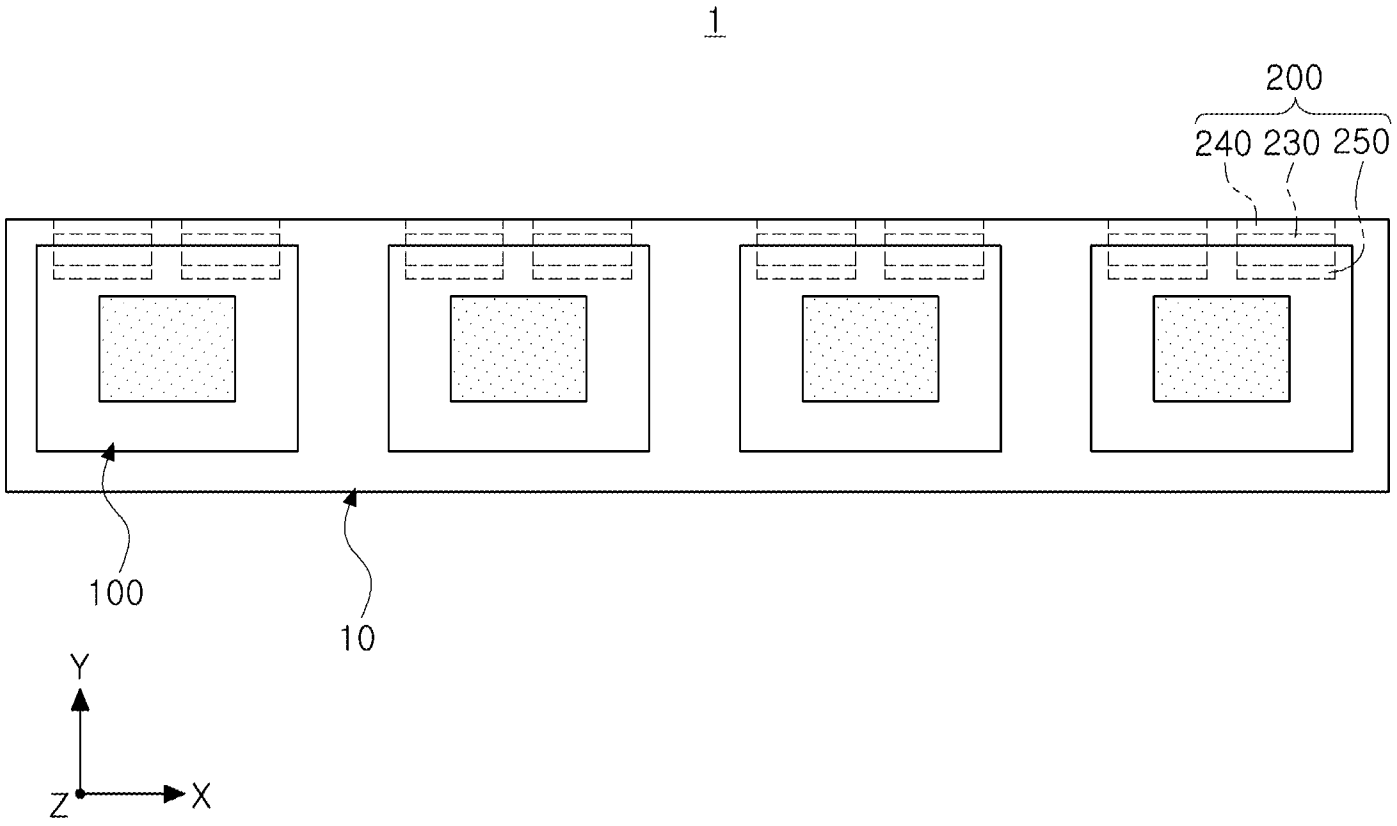
FIG. 3B illustrates a modified example of the chip antenna module of FIG. 3A.

FIG. 1 is a perspective view of an example of a chip antenna module, FIG. 2A is a cross-sectional view of a portion of the chip antenna module of FIG. 1, FIG. 3A is a plan view of the chip antenna module of FIG. 1, and FIG. 3B illustrates a modified embodiment of the chip antenna module of FIG. 3A.

Referring to FIGS. 1, 2A, and 3A, a chip antenna module 1 according to an embodiment includes a substrate 10, an electronic device 50, and a chip antenna 100, and may further include an end-fire antenna 200. In the substrate 10, at least one electronic device 50, a plurality of chip antennas 100, and a plurality of end-fire antennas 200 may be disposed.

Herein, it is noted that use of the term 'may' with respect to an example or embodiment, e.g., as to what an example or embodiment may include or implement, means that at least one example or embodiment exists where such a feature is included or implemented while all examples and embodiments are not limited thereto.

The substrate 10 may be a circuit board with a circuit or an electronic component, required for the chip antenna 100. As an example, the substrate 10 may be a printed circuit board (PCB) with one or more electronic components mounted on its surface. Thus, the substrate 10 may be provided with a circuit wiring to electrically connect electronic components to each other. Moreover, the substrate 10 may be provided as a flexible substrate, a ceramic substrate, a glass substrate, or the like. The substrate 10 may be composed of a plurality of layers. In detail, the substrate 10 may be formed as a multilayer substrate formed by alternately stacking at least one insulating layer 17 and at least one wiring layer 16. At least one wiring layer 16 may include two outer layers provided on surfaces of the substrate 10 and at least one inner layer provided between the two outer layers. As an example, the insulating layer 17 may be formed of an insulating material such as prepreg, an Ajinomoto build-up film (ABF), FR-4, or Bismaleimide Triazine (BT). The insulating layer may be formed using a thermosetting resin such as an epoxy resin, a thermoplastic resin such as a polyimide resin, a resin in which the thermosetting resin or the thermoplastic resin is impregnated together with an inorganic filler in a core material such as a glass fiber (or a glass cloth or a glass fabric). According to an embodiment, the insulating layer 17 may be formed using a photosensitive insulating resin.

The wiring layer 16 may electrically connect the electronic device 50, the plurality of chip antennas 100, and the plurality of end-fire antennas 200. Moreover, the wiring layer 16 may electrically connect the plurality of electronic devices 50, the plurality of chip antennas 100, and the plurality of end-fire antennas 200 to an outside.

The wiring layer 16 may include a conductive material such as copper (Cu), aluminum (Al), silver (Ag), tin (Sn), gold (Au), nickel (Ni), lead (Pb), titanium (Ti), or alloys thereof.

In the insulating layer 17, wiring vias 18 for interconnection of the wiring layer 16 are disposed.

The chip antenna 100 is mounted on one side of the substrate 10, specifically, on an upper surface of the substrate 10. The chip antenna 100 may have a width extended in a Y-direction, a length extended in an X-direction, intersecting and perpendicular to the Y-direction, and a height extended in a Z-direction. The chip antenna 100, as illustrated in FIG. 1, may be arranged in a structure of n×1. The plurality of chip antennas 100 are arranged in the X-direction, and widths of two chip antennas 100, adjacent to each other in the X-direction, of the plurality of chip antennas 100, may oppose each other.

According to an embodiment, the chip antenna 100 may be arranged in a structure of n×m. The plurality of chip antennas 100 are arranged in the X-direction and the Y-direction. Here, lengths of two chip antennas, adjacent to each other, of the plurality of chip antennas 100, may oppose each other in the Y-direction, while widths of two chip antennas, adjacent to each other, of the plurality of chip antennas 100, may oppose each other in the X-direction.

Centers of chip antennas 100, adjacent to each other in at least one direction between the X-direction and the Y-direction, may be spaced apart from each other by $\lambda/2$. Here, $\lambda$ indicates the wavelength of an RF signal transmitted and received by the chip antennas 100.

When the chip antenna module 1 according to an embodiment of the present disclosure transmits and receives an RF signal in the 20 GHz to 40 GHz band, centers of chip antennas 100 adjacent to each other may be spaced apart from each other by 3.75 mm to 7.5 mm. When the chip antenna module 1 transmits and receives an RF signal in the 28 GHz band, the centers of chip antennas may be spaced apart from each other by 5.36 mm.

The RF signal, used in the 5G communication system, has a shorter wavelength and greater energy as compared with an RF signal used in the 3G/4G communication system, in terms of characteristics. Thus, in order to significantly reduce interference between RF signals transmitted and received by respective chip antennas 100, it is desirable for the chip antennas 100 to have a sufficient separation distance.

According to an embodiment of the present disclosure, centers of chip antennas 100 are sufficiently spaced apart from each other by $\lambda/2$, so interference of RF signals transmitted and received by the chip antennas 100 is significantly reduced. Thus, the chip antenna 100 is used in the 5G communication system.

Meanwhile, according to an embodiment, a separation distance between centers of chip antennas 100 adjacent to each other may be smaller than $\lambda/2$. As will be described later, each of the chip antennas 100 is configured as at least one patch antenna provided on ceramic substrates and a portion of ceramic substrates. In this case, ceramic substrates are spaced apart from each other by a predetermined distance, or a material having permittivity lower than that of ceramic substrates is disposed between the ceramic substrates, so overall permittivity of the chip antenna 100 may be reduced. Thus, the wavelength of an RF signal transmitted and received by the chip antenna 100 is increased, so the radiation efficiency and gain may be improved. Thus, even when adjacent chip antennas 100 are arranged to allow a separation distance between centers of chip antennas 100 adjacent to each other to be smaller than λ/2 of the RF signal, interference between RF signals may be significantly reduced. The chip antenna module 1 according to an embodiment of the present disclosure transmits and receives an RF signal in the 28 GHz band, a separation distance between centers of chip antennas 100 adjacent to each other may be smaller than 5.36 mm.

A feed pad 16*a* providing a feed signal to the chip antenna 100 may be provided in an upper surface of the substrate 10. Meanwhile, a ground layer 16*b* is provided on any one inner layer among a plurality of layers of the substrate 10. As an example, the wiring layer 16 disposed on a lower layer, which is the most adjacent to an upper surface of the substrate 10 is used as a ground layer 16*b*. The ground layer 16*b* is operated as a reflector of the chip antenna 100. Thus, the ground layer 16*b* may concentrate an RF signal by reflecting the RF signal, output by the chip antenna 100, in the Z-direction, corresponding to an aim direction.

In FIG. 2A, it is illustrated that the ground layer 16*b* is disposed on a lower layer, which is the most adjacent to an upper surface of the substrate 10. However, according to an embodiment, the ground layer 16*b* may be provided on an upper surface of the substrate 10 or may be provided on another layer.

Moreover, a top pad 16*c*, bonded to the chip antenna 100, is provided on an upper surface of the substrate 10. The electronic device 50 may be mounted on the other side of the substrate 10, specifically, on a lower surface. A bottom pad 16*d*, electrically connected to the electronic device 50, is provided on a lower surface of the substrate 10.

An insulating protective layer 19 may be disposed on the lower surface of the substrate 10. The insulating protective layer 19 is disposed to cover the insulating layer 17 and the wiring layer 16 in a lower surface of the substrate 10, and protect the wiring layer 16 disposed on a lower surface of the insulating layer 17. As an example, the insulating protective layer 19 may include an insulating resin and an inorganic filler. The insulating protective layer 19 may have an opening exposing at least a portion of the wiring layer 16. Through a solder ball disposed on the opening, the electronic device 50 may be mounted on the bottom pad 16*d*.

Figure 2B:
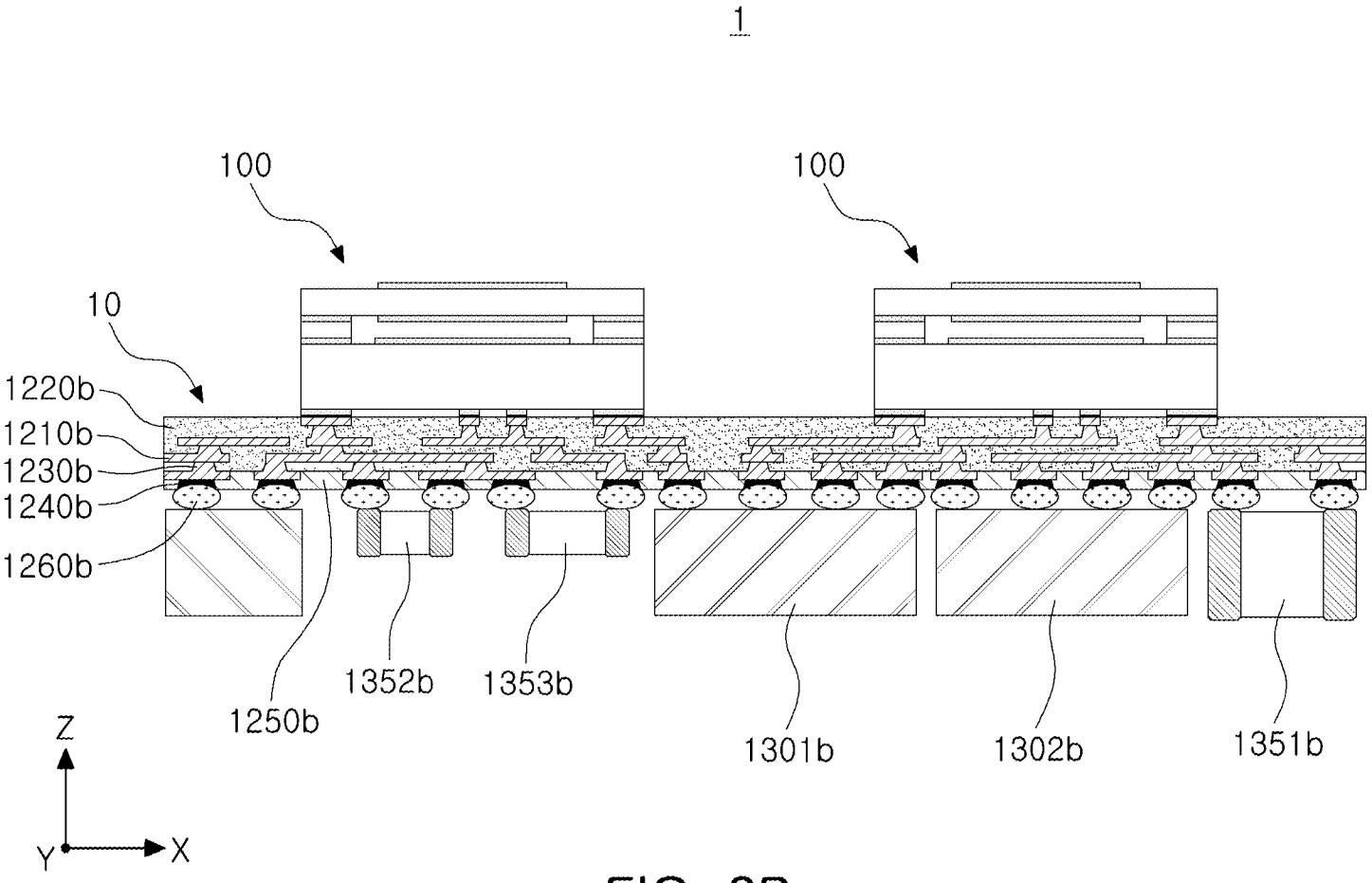
FIGS. 2B and 2C illustrate a modified example of the chip antenna module of FIG. 2A.
Figure 2C:
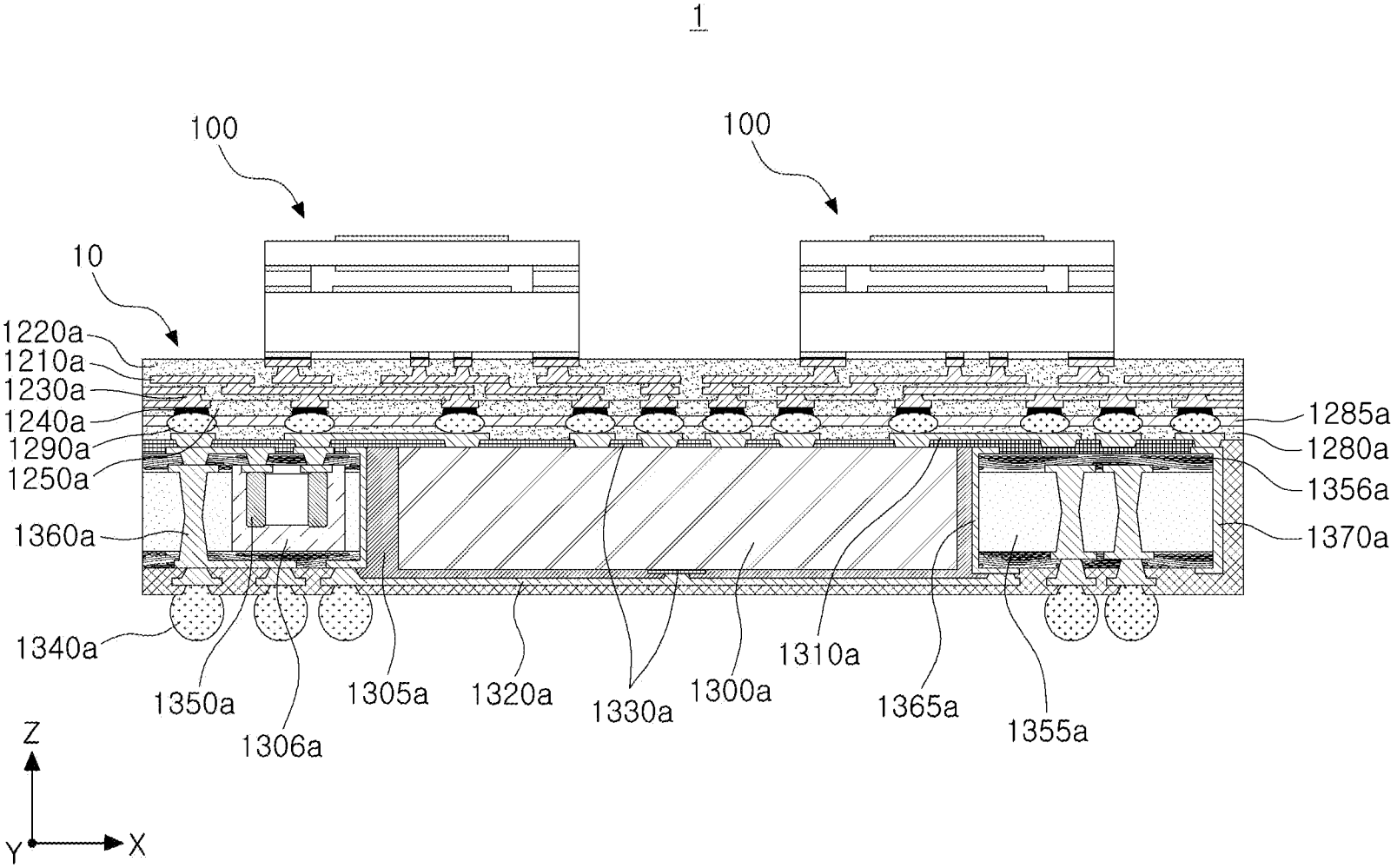

FIGS. 2B and 2C illustrate a modified example of the chip antenna module of FIG. 2A.

The chip antenna module, according to examples of FIGS. 2B and 2B, is similar to the chip antenna module of FIG. 2A, so duplicate explanations will be omitted and differences will be mainly described.

Referring to FIG. 2B, the substrate 10 includes at least one wiring layer 1210*b*, at least one insulating layer 1220*b*, a wiring via 1230*b* connected to the at least one wiring layer 1210*b*, a connection pad 1240*b* connected to the wiring via 1230*b*, and a solder resist layer 1250*b*. The substrate 10 may have a structure similar to that of a copper redistribution layer (RDL). A chip antenna may be disposed on an upper surface of the substrate 10.

An integrated circuit chip (IC) 1301*b*, a power management integrated chip (PMIC) 1302*b*, and a plurality of passive components 1351*b*, 1352*b*, and 1353*b* may be mounted on a lower surface of a substrate through the solder ball 1260*b*. The IC 1301*b* corresponds to an IC for operating the chip antenna module 1. The PMIC 1302*b* generates power, and the generated power may be transmitted to the IC 1301*b* through the at least one wiring layer 1210*b* of the substrate 10.

The plurality of passive components 1351*b*, 1352*b*, and 1353*b* may provide an impedance to the IC 1301*b* and/or the PMIC 1302*b*. For example, the plurality of passive components 1351*b*, 1352*b*, and 1353*b* may include at least a portion of a capacitor such as a multilayer ceramic capacitor (MLCC), an inductor, and a chip resistor.

Referring to FIG. 2C, the substrate 10 may include at least one wiring layer 1210*a*, at least one insulating layer 1220*a*, a wiring via 1230*a*, a connection pad 1240*a*, and a solder resist layer 1250*a*.

An electronic component package is mounted on a lower surface of the substrate 10. The electronic component package may include an IC 1300*a*, an encapsulant 1305*a* sealing at least a portion of the IC 1300*a*, a supporting member 1355*a* having a first side surface opposing the IC 1300*a*, at least one wiring layer 1310*a* electrically connected to the IC 1300*a* and the supporting member 1355*a*, and a connection member including an insulating layer 1280*a*.

An RF signal, generated by the IC 1300*a*, may be transferred to the substrate 10 through at least one wiring layer 1310*a* and transmitted in the direction of an upper surface of the chip antenna module 1. An RF signal, received by the chip antenna module 1, may be transferred to the IC 1300*a* through at least one wiring layer 1310*a*.

The electronic component package may further include a connection pad 1330*a* in one side and/or the other side of the IC 1300*a*. A connection pad 1330*a*, disposed on one side of the IC 1300*a*, may be electrically connected to at least one wiring layer 1310*a*. A-a connection pad 1330*a*, disposed on the other side of the IC 1300*a*, may be electrically connected to the supporting member 1355*a* or the core plating member 1365*a* through the bottom wiring layer 1320*a*. The core plating member 1365*a* may provide ground to the IC 1300*a*.

The supporting member 1355*a* may include a core dielectric layer 1356*a* and at least one core via 1360*a* passing through the core dielectric layer 1356*a* and electrically connected to the bottom wiring layer 1320*a*. The core via 1360*a* may be electrically connected to the electrical connection structure 1340*a*, such as a solder ball, a pin, or a land. Thus, the supporting member 1355*a* receives a base signal or power from a lower surface of the substrate 10 to transmit the base signal or power to the IC 1300*a* through at least one wiring layer 1310*a*.

The IC 1300*a* may generate an RF signal in a millimeter-wave (mmWave) band using the base signal and/or power. For example, the IC 1300*a* receives a base signal having a low frequency and performs frequency conversion of the base signal, amplification, filtering phase control, and power generation. The IC 1300*a* may be formed as one between a compound semiconductor (for example, GaAs) and a silicon semiconductor, in order to implement high-frequency characteristics. Meanwhile, the electronic component package may further include a passive component 1350*a* electrically connected to at least one wiring layer 1310*a*. The passive component 1350*a* may be disposed in an accommodation space 1306*a* provided by the supporting member 1355*a*. The passive component 1350*a* may include at least a portion of a ceramic capacitor (for example, a multilayer ceramic capacitor, MLCC), an inductor, or a chip resistor.

Meanwhile, the electronic component package may include core plating members 1365*a* and 1370*a* disposed on a side surface of the supporting member 1355*a*. The core plating members 1365*a* and 1370*a* may provide ground to the IC 1300*a* and may dissipate heat of the IC 1300*a* outside or remove noise flowing into the IC 1300*a*.

Each of a configuration of an electronic component package except a connection member, and a connection member is independently manufactured and then combined with each other, but may be manufactured together according to the design. FIG. 2C illustrates an electronic component package that is combined with the substrate 10 through the electrical connection structure 1290*a* and the solder resist layer 1285*a*. However, according to an embodiment, the electrical connection structure 1290*a* and the solder resist layer 1285*a* may be omitted.

Referring to FIG. 3A, the chip antenna module 1 may further include at least one end-fire antenna 200. Each end-fire antenna 200 may include an end-fire antenna pattern 210, a director pattern 215, and an end-fire feedline 220.

The end-fire antenna pattern 210 may transmit or receive an RF signal in the direction of a side surface. The end-fire antenna pattern 210 may be disposed on a side surface of the substrate 10 and may be provided in the form of a dipole or in the form of a folded dipole. The director pattern 215 may be electromagnetically coupled to an end-fire antenna pattern 210 to improve the gain or bandwidth of the plurality of end-fire antenna patterns 210. The end-fire feedline 220 may transmit the RF signal, received by the end-fire antenna pattern 210 to the electronic device or IC, and may transmit the RF signal, transmitted by the electronic device or IC, to the end-fire antenna pattern 210.

The end-fire antenna 200, formed by a wiring pattern of FIG. 3A, may be implemented as an end-fire antenna 200 in the form of a chip, as illustrated in FIG. 3B.

Referring to FIG. 3B, each end-fire antenna 200 includes a body portion 230, a radiating unit 240, and a grounding unit 250.

The body portion 230 has a hexahedral shape and is formed of a dielectric substance. For example, the body portion 230 may be formed of a polymer or a ceramic sintered body, having predetermined permittivity.

The radiating unit 240 is bonded to a first surface of the body portion 230, and the grounding unit 250 is bonded to a second surface, opposite to the first surface of the body portion 230. The radiating unit 240 and the grounding unit 250 may be formed of the same material. The radiating unit 240 and the grounding unit 250 may be formed of one type selected from Ag, Au, Cu, Al, Pt, Ti, Mo, Ni, and W or an alloy formed of two or more types. The radiating unit 240 and the grounding unit 250 may be formed to have the same shape or the same structure. The radiating unit 240 and the grounding unit 250 may be divided according to the type of the pad to be bonded when mounted on the substrate 10. As an example, a portion bonded to a feed pad may function as the radiating unit 240, and a portion bonded to a ground pad may function as the grounding unit 250.

The end-fire antenna 200 in the form of a chip has capacitance due to a dielectric substance between the radiating unit 240 and the grounding unit 250, so a coupling antenna is designed, or a resonant frequency is tuned, using the capacitance.

Typically, in order to secure sufficient antenna characteristics in a patch antenna implemented as a pattern inside a multilayer board, multiple layers were required in a substrate. However, such a structure may cause a problem by excessively increasing the volume of a patch antenna. The problem may be solved by a method of disposing an insulator having high permittivity in a multilayer board to reduce the thickness of the insulator, thus, reducing the size and thickness of the antenna pattern.

However, if permittivity of the insulator is increased, the wavelength of an RF signal is shortened and the RF signal is blocked by an insulator having high permittivity. Thus, a problem occurs in which the radiation efficiency and gain of the RF signal are significantly reduced.

According to an embodiment of the present disclosure, a patch antenna, which was implemented in the form of a pattern in a multilayer board in typical applications, is implemented in the form of a chip, so that the number of layers of a substrate with a chip antenna mounted thereon may be significantly reduced. Thus, the manufacturing costs and volume of the chip antenna module 1 in an embodiment could be reduced.

In addition, according to an embodiment of the present disclosure, permittivity of ceramic substrates, provided in the chip antenna 100, is formed higher than the permittivity of an insulating layer, provided on the substrate 10, so the chip antenna 100 could be miniaturized.

Furthermore, ceramic substrates of the chip antenna 100 are spaced apart from each other by a predetermined distance, or a material having permittivity lower than that of ceramic substrates is disposed between the ceramic substrates, so overall permittivity of the chip antenna 100 may be reduced. Thus, while the chip antenna 100 is miniaturized, the wavelength of an RF signal is increased, so the radiation efficiency and gain may be improved. Here, the overall permittivity of the chip antenna 100 could be understood as the permittivity formed by ceramic substrates of the chip antenna 100 and a gap between the ceramic substrates or permittivity formed by ceramic substrates of the chip antenna 100 and a material disposed between the ceramic substrates. Thus, when ceramic substrates of the chip antenna 100 are spaced apart from each other by a predetermined distance, or a material having permittivity lower than that of ceramic substrates is disposed between the ceramic substrates, overall permittivity of the chip antenna 100 may be lower than the permittivity of ceramic substrates.

Figure 4A:
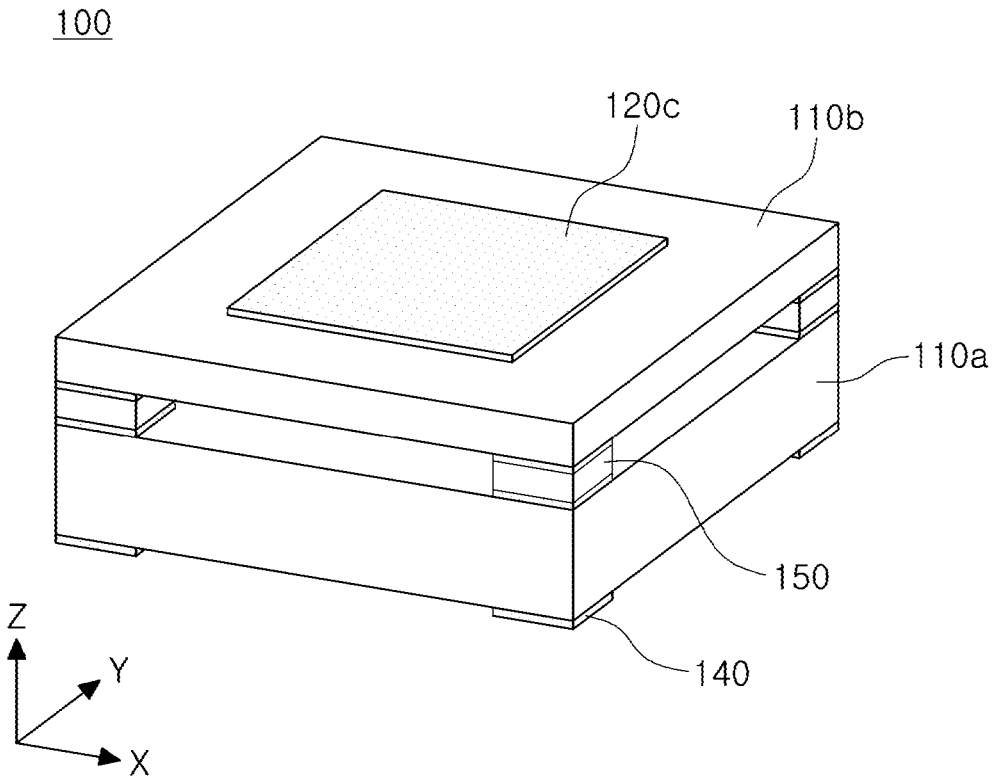
FIG. 4A is a perspective view of an example of a chip antenna.
Figure 4B:
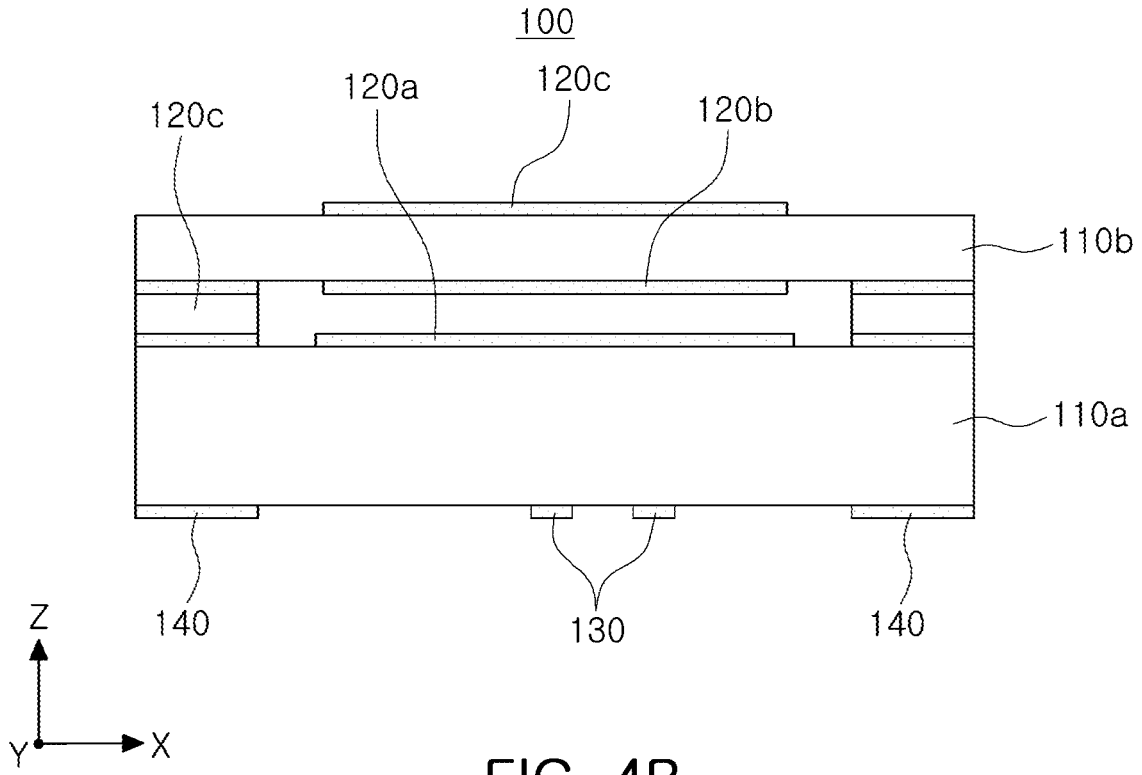
FIG. 4B is a side view of the chip antenna of FIG. 4A.
Figure 4C:
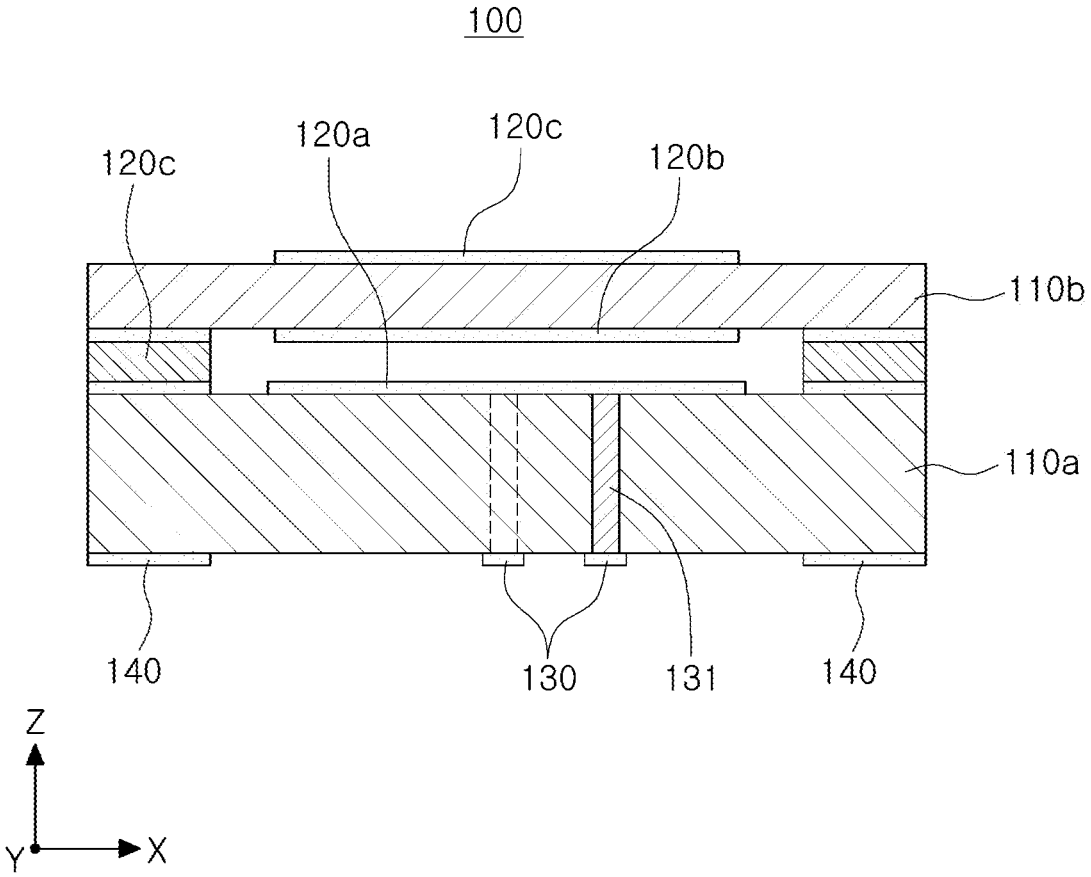
FIG. 4C is a cross-sectional view of the chip antenna of FIG. 4A.
Figure 4D:
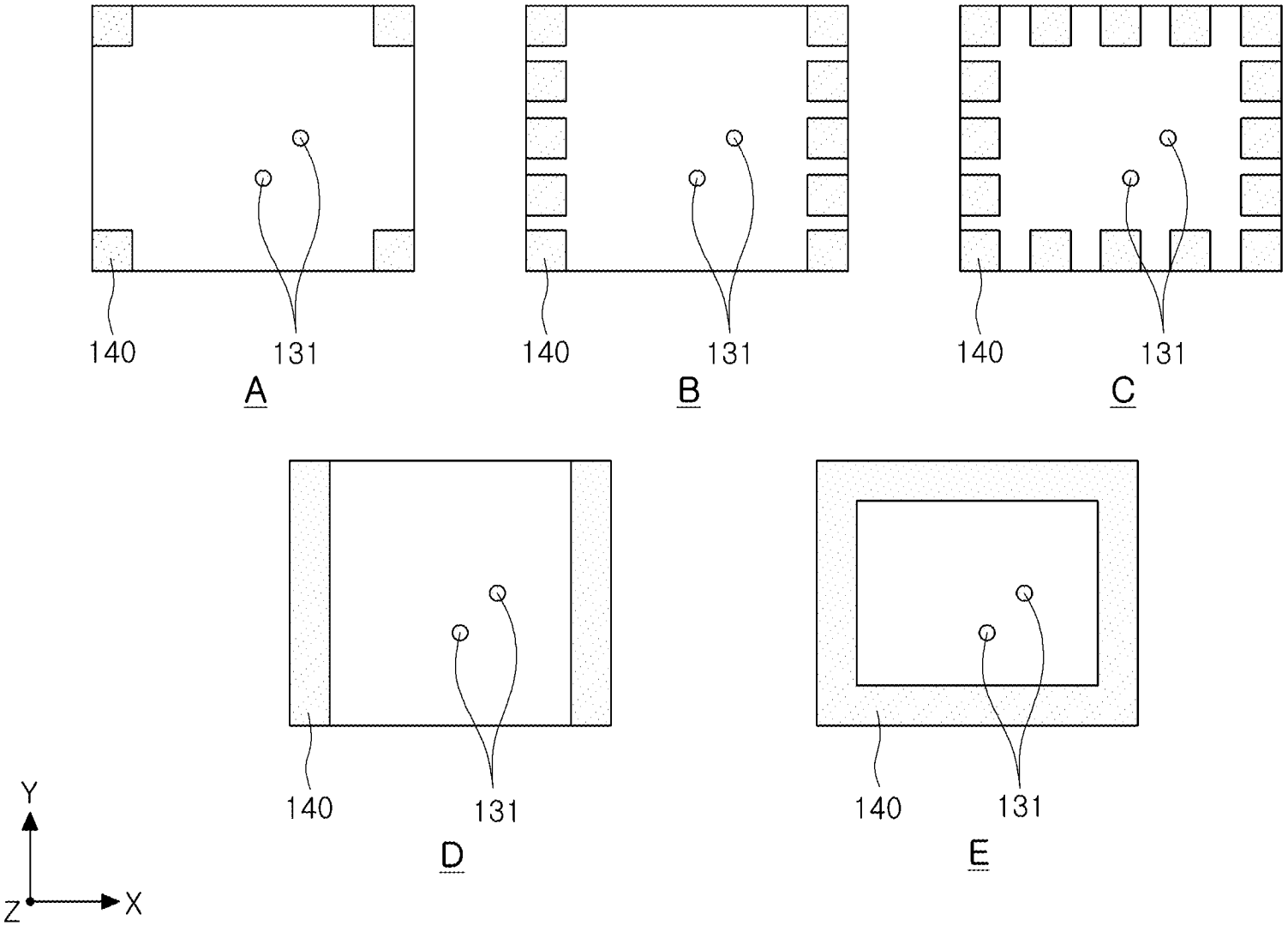
FIG. 4D is a bottom view of the chip antenna of FIG. 4A.
Figure 4E:
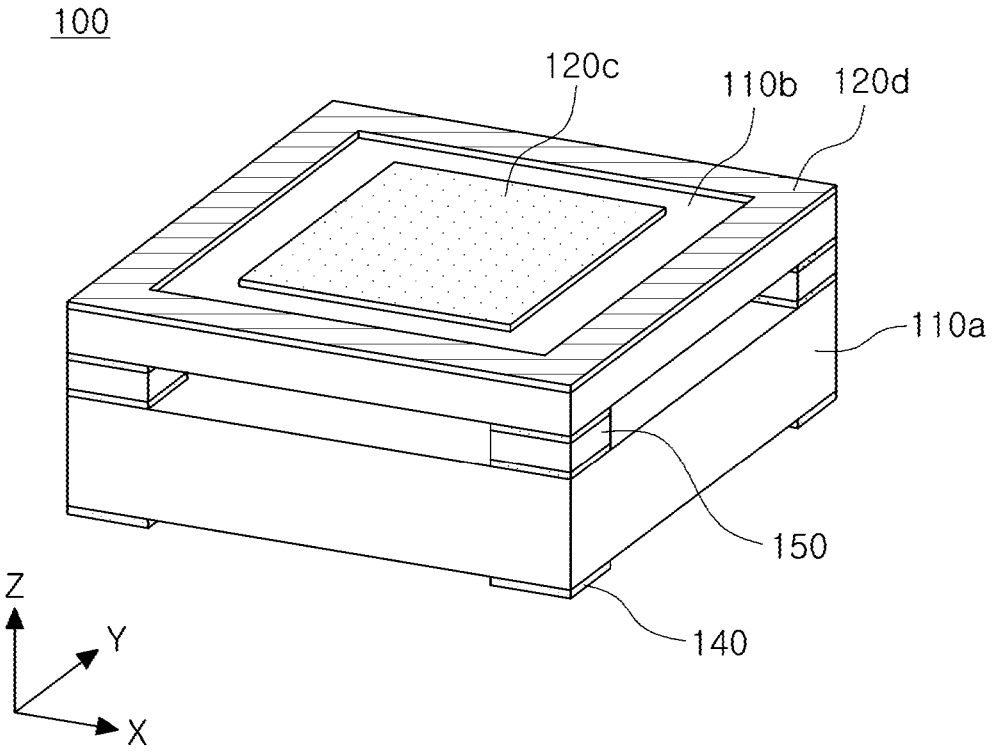
FIG. 4E is a perspective view of a modified example of the chip antenna of FIG. 4A.

FIG. 4A is a perspective view of a chip antenna according to an example of the present disclosure, FIG. 4B is a side view of the chip antenna of FIG. 4A, FIG. 4C is a cross-sectional view of the chip antenna of FIG. 4A, FIG. 4D is a bottom view of the chip antenna of FIG. 4A, and FIG. 4E is a perspective view of a modified embodiment of the chip antenna of FIG. 4A.

Referring to FIGS. 4A, 4B, 4C, and 4D, a chip antenna 100 according to an example of the present disclosure includes a first ceramic substrate 110*a*, a second ceramic substrate 110*b*, and a first patch antenna 120*a*, and may include at least one of a second patch antenna 120*b* and a third patch antenna 120*c*.

The first patch antenna 120*a* may be formed of metal in the form of a flat plate having a constant area. As an example, the first patch antenna 120*a* may have a quadrangular shape. However, according to an embodiment, the first patch antenna may have various shapes such as a polygonal shape, a circular shape, and the like. The first patch antenna 120*a* is connected to the feed via 131, and thus may function and be operated as a feed patch antenna.

The second patch antenna 120*b* and the third patch antenna 120*c* are spaced apart from the first patch antenna 120*a* by a predetermined distance and may be formed of a flat metal plate having a constant area. The second patch antenna 120*b* and the third patch antenna 120*c* may have an area the same as or different from that of the first patch antenna 120*a*. As an example, the second patch antenna 120*b* and the third patch antenna 120*c* may be formed to have an area smaller than the first patch antenna 120*a* and may be disposed on an upper portion of the first patch antenna 120*a*. As an example, the second patch antenna 120*b* and the third patch antenna 120*c* may be formed smaller than the first patch antenna 120*a* by 5% to 8%. As an example, thicknesses of the first patch antenna 120*a*, the second patch antenna 120*b*, and the third patch antenna 120*c* may be 20 μm.

The second patch antenna 120*b* and the third patch antenna 120*c* may be electromagnetically coupled to the first patch antenna 120*a*, and thus may function and be operated as a radiation patch. The second patch antenna 120*b* and the third patch antenna 120*c* may further concentrate an RF signal in a Z-direction corresponding to a mounting direction of the chip antenna 100, and thus may improve the gain or bandwidth of the first patch antenna 120*a*. The chip antenna 100 may include at least one of the second patch antenna 120*b* and the third patch antenna 120*c*, functioning as a radiation patch.

The first ceramic substrate 110*a* may be formed of a dielectric substance having predetermined permittivity. As an example, the first ceramic substrate 110*a* may be formed of a ceramic sintered body having a hexahedral shape. The first ceramic substrate 110*a* may contain magnesium (Mg), silicon (Si), aluminum (Al), calcium (Ca), and titanium (Ti). As an example, the first ceramic substrate 110*a* may include $Mg_2Si0_4$, $MgAl_2O_4$, and $CaTiO_3$. As another example, the first ceramic substrate 110*a* may further include $MgTiO_3$, in addition to $Mg_2Si0_4$, $MgAl_2O_4$, and $CaTiO_3$. According to an embodiment, $CaTiO_3$ is replaced with $MgTiO_3$, so the first ceramic substrate 110*a* may include $Mg_2Si0_4$, $MgAl_2O_4$, and $MgTiO_3$.

When the distance between the ground layer 16*b* of the chip antenna module 1 and the first patch antenna 120*a* of the chip antenna 100 corresponds to λ/10 to λ/20, the ground layer 16*b* may efficiently reflect an RF signal, output by the chip antenna 100, in an aim direction.

When the ground layer 16*b* is provided on an upper surface of the substrate 10, the distance between the ground layer 16*b* of the chip antenna module 1 and the first patch antenna 120*a* of the chip antenna 100 is substantially equal to the sum of the thickness of the first ceramic substrate 110*a* and the thickness of the connection pad 140.

Thus, the thickness of the first ceramic substrate 110*a* may be determined according to a design distance (e.g., λ/10 to λ/20) between the ground layer 16*b* and the first patch antenna 120*a*. As an example, the thickness of the first ceramic substrate 110*a* may correspond to 90% to 95% of λ/10 to λ/20. As an example, when permittivity of the first ceramic substrate 110*a* is 5 to 12 at 28 GHz, the thickness of the first ceramic substrate 110*a* may be 150 μm to 500 μm.

A first patch antenna 120*a* is provided on one side of the first ceramic substrate 110*a*, while a feed pad 130 is provided on the other side of the first ceramic substrate 110*a*. At least one feed pad 130 may be provided on the other side of the first ceramic substrate 110*a*. The thickness of the feed pad 130 may be 20 μm.

The feed pad 130, provided on the other side of the first ceramic substrate 110*a*, may be electrically connected to the feed pad 16*a*, provided on one side of the substrate 10. The feed pad 130 is electrically connected to the feed via 131 passing through the first ceramic substrate 110*a* in a thickness direction. The feed via 131 may provide a feed signal to the first patch antenna 110*a* provided on one side of the first ceramic substrate 110*a*. At least one feed via 131 may be provided. As an example, two feed vias 131 may be provided to correspond to two feed pads 130. One feed via 131, of two feed vias 131, may correspond to a feed line for generating vertical polarization, while the other feed via 131 may correspond to a feed line for generating horizontal polarization. The diameter of the feed via 131 may be 150 μm. A connection pad 140 is provided on the other side of the first ceramic substrate 110*a*. The connection pad 140, provided on the other side of the first ceramic substrate 110*a*, may be bonded to a top pad 16*c* provided on one side of the substrate 10. As an example, the connection pad 140 of the chip antenna 100 may be bonded to the top pad 16*c* of the substrate 10, through a solder paste. The thickness of the connection pad 140 may be 20 μm.

Referring to FIG. 4D, a connection pad 140 is provided as a plurality of connection pads, and the connection pads may be provided on each corner of a quadrangular shape, in the other side of the first ceramic substrate 110*a*.

Referring to B of FIG. 4D, a plurality of connection pads 140 may be provided to be spaced apart from each other by a predetermined distance on opposing peripheral sides of a quadrangular shape, on the other side of the first ceramic substrate 110*a*.

Referring to C of FIG. 4D, a plurality of connection pads 140 may be provided to be spaced apart from each other by a predetermined distance on each of four peripheral sides of a quadrangular shape, on the other side of the first ceramic substrate 110*a*.

Referring to D of FIG. 4D, the connection pads 140 may be provided to have a shape having a length corresponding each of opposing peripheral sides of a quadrangular shape, on the other side of the first ceramic substrate 110*a*.

Moreover, referring to E of FIG. 4D, the connection pads 140 may be provided to have a shape having a length corresponding to four sides, according to each of four peripheral sides of a quadrangular shape, on the other side of the first ceramic substrate 110*a*.

While A, B, and C of FIG. 4D illustrate the connection pad 140 having a quadrangular shape, the shape of the connection pad 140 is not limited thereto and may have various shapes such as a circle, or the like, according to an embodiment. In addition, in A, B, C, and D of FIG. 4D, it is illustrated that the connection pads 140 are disposed adjacent to four sides of a quadrangular shape, but the connection pads 140 may be disposed to be spaced apart from four sides by a predetermined distance, according to an embodiment.

The second ceramic substrate 110*b* may be formed of a dielectric substance having predetermined permittivity. As an example, the second ceramic substrate 110*b* may be formed as a ceramic sintered body having a hexahedral shape similar to that of the first ceramic substrate 110*a*. The second ceramic substrate 110*b* may have permittivity equal to that of the first ceramic substrate 110*a* but may have permittivity different from that of the first ceramic substrate 110*a*, according to an embodiment. As an example, the permittivity of the second ceramic substrate 110*b* may be higher than the permittivity of the first ceramic substrate 110*a*. According to an embodiment of the present disclosure, when the permittivity of the second ceramic substrate 110*b* is higher than the permittivity of the first ceramic substrate 110*a*, an RF signal is radiated toward the second ceramic substrate 110*b* having high permittivity, so the gain of the RF signal may be improved.

The second ceramic substrate 110*b* may have a thickness less than that of the first ceramic substrate 110*a*. The thickness of the first ceramic substrate 110*a* may correspond to 1 to 5 times the thickness of the second ceramic substrate 110*b*, and preferably may be 2 to 3 times the thickness of the second ceramic substrate. As an example, the thickness of the first ceramic substrate 110*a* may be 150 μm to 500 μm, and the thickness of the second ceramic substrate 110*b* may be 100 μm to 200 μm. Preferably, the thickness of the second ceramic substrate 110*b* may be 50 μm to 200 μm. Meanwhile, according to an embodiment, the second ceramic substrate 110*b* may have a thickness equal to that of the first ceramic substrate 110*a*.

According to an embodiment of the present disclosure, based on the thickness of the second ceramic substrate 110*b*, an appropriate distance between the first patch antenna 120*a* and the second patch antenna 120*b*/and the third patch antenna 120*c* is maintained, so the radiation efficiency of an RF signal may be improved.

The permittivity of the first ceramic substrate 110*a* and the second ceramic substrate 110*b* may be higher than the permittivity of the substrate 10, specifically, the permittivity of the insulating layer 17 provided on the substrate 10. As an example, the permittivity of the first ceramic substrate 110*a* and the second ceramic substrate 110*b* may be 5 to 12 at 28 GHz, while the permittivity of the substrate 10 may be 3 to 4 at 28 GHz. Thus, a volume of a chip antenna is reduced, so miniaturization of the entire chip antenna module could be promoted. As an example, the chip antenna 100 according to an embodiment of the present disclosure may be manufactured in the form of a small chip having a length of 3.4 mm, a width of 3.4 mm, and a height of 0.64 mm. A second patch antenna 120*b* is provided on the other side of the second ceramic substrate 110*b*, while a third patch antenna 120*c* is provided on one side of the second ceramic substrate 110*b*.

Referring to FIG. 4E, on one side of the second ceramic substrate 110*b*, a shield electrode 120*d* insulated from the third patch antenna 120*c*, and formed along an edge region of the second ceramic substrate 110*b* may be provided. The shield electrode 120*d* may reduce interference between the chip antennas 100, when the chip antenna 100 is arranged in the form of an array such as a structure of n×1. Thus, when the chip antenna 100 is arranged in the form of an array of 4×1, the chip antenna module 1 according to an embodiment of the present disclosure may be manufactured as a small module having a length of 19 mm, a width of 4.0 mm, and a height of 1.04 mm.

The first ceramic substrate 110*a* and the second ceramic substrate 110*b* may be spaced apart from each other through the spacer 150. The spacer 150 may be provided on each corner of a quadrangular shape of the first ceramic substrate 110*a*/the second ceramic substrate 110*b*, between the first ceramic substrate 110*a* and the second ceramic substrate 110*b*. Moreover, according to an embodiment, the spacer may be provided on opposing peripheral sides of a quadrangular shape of the first ceramic substrate 110*a*/the second ceramic substrate 110*b*, or may be provided on four sides of a quadrangular shape of the first ceramic substrate 110*a*/the second ceramic substrate 110*b*, thereby stably supporting the second ceramic substrate 110*b* in an upper portion of the first ceramic substrate 110*a*. Due to the spacer 150, a gap may be provided between the first patch antenna 120*a*, provided on one side of the first ceramic substrate 110*a*, and the second patch antenna 120*b*, provided on the other side of the second ceramic substrate 110*b*. A space, formed by the gap, is filled with air having permittivity of 1, and thus, overall permittivity of the chip antenna 100 may be lowered.

According to an embodiment of the present disclosure, the first ceramic substrate 110*a* and the second ceramic substrate 110*b* are formed of a material having permittivity higher than that of the substrate 10, and thus a chip antenna module may be miniaturized. Moreover, as a gap is prepared between the first ceramic substrate 110*a* and the second ceramic substrate 110*b*, overall permittivity of the chip antenna 100 is lowered, so radiation efficiency and gain may be improved.

Figure 5A:
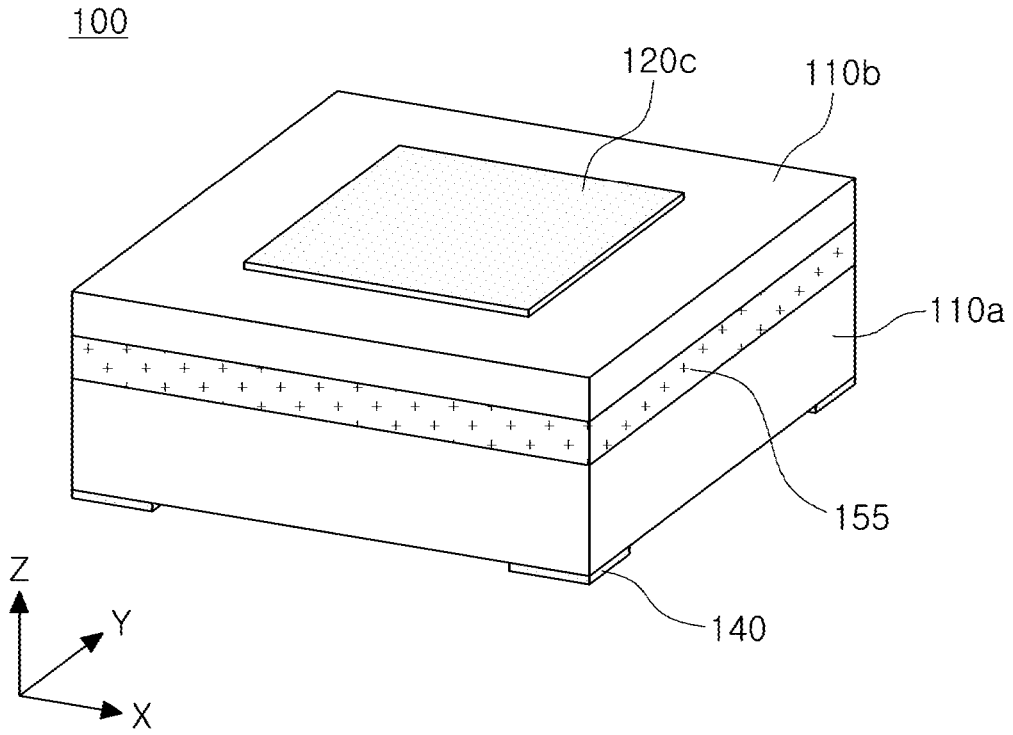
FIG. 5A is a perspective view of another example of a chip antenna.
Figure 5B:
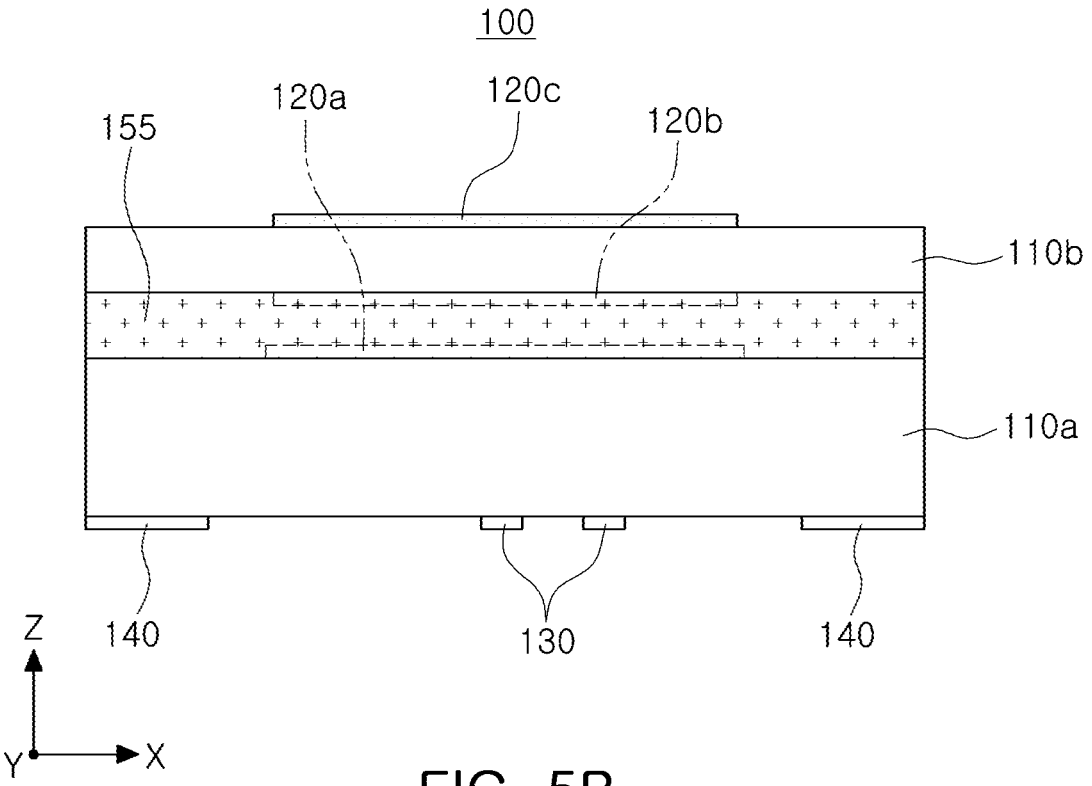
FIG. 5B is a side view of the chip antenna of FIG. 5A.
Figure 5C:
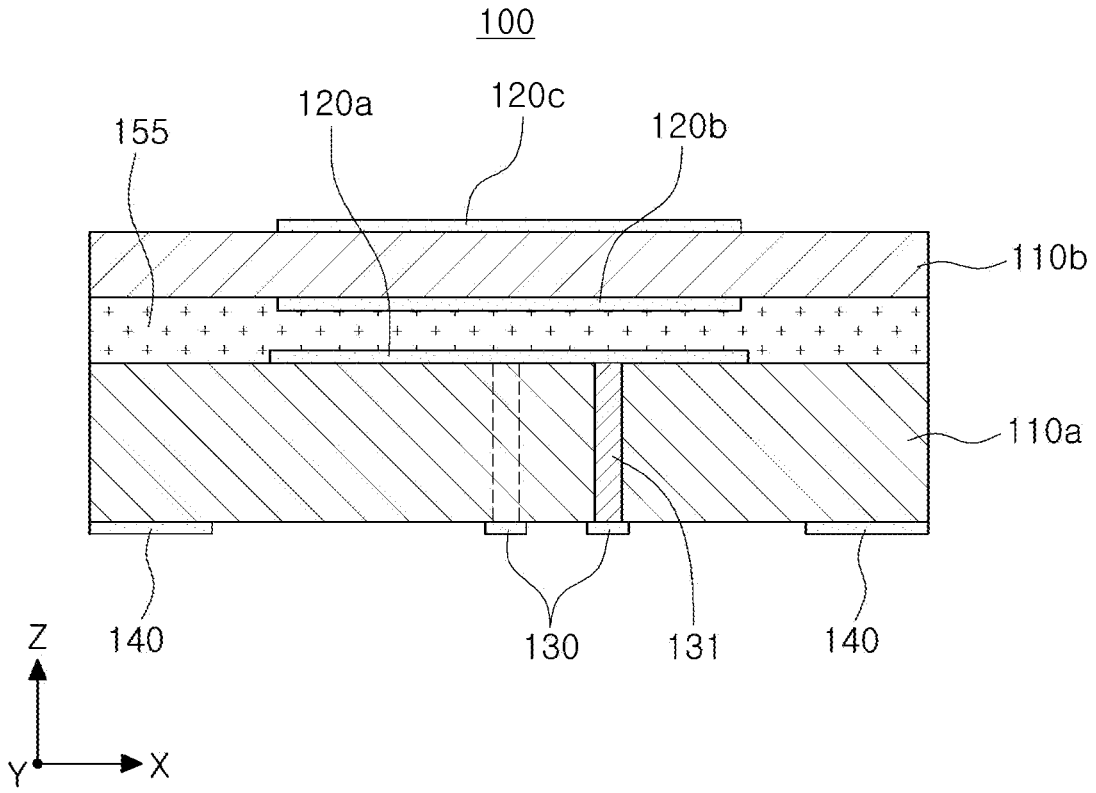
FIG. 5C is a cross-sectional view of the chip antenna of FIG. 5A.

FIG. 5A is a perspective view of a chip antenna according to another example of the present disclosure, FIG. 5B is a side view of the chip antenna of FIG. 5A, and FIG. 5C is a cross-sectional view of the chip antenna of FIG. 5A. A chip antenna according to another example is similar to the chip antenna according to the first example, so duplicate descriptions are omitted, and differences will be mainly described.

Through the spacer 150, the first ceramic substrate 110*a* and the second ceramic substrate 110*b* of the chip antenna 100 according to an example are spaced apart from each other. As compared to the case described above, through a bonding layer 155, the first ceramic substrate 110*a* and the second ceramic substrate 110*b* of the chip antenna 100 according to another example are bonded to each other. It could be understood that the bonding layer 155 according to the second embodiment is provided in a space formed by a gap between the first ceramic substrate 110*a* and the second ceramic substrate 110*b* according to the first embodiment.

The bonding layer 155 is formed to cover one side of the first ceramic substrate 110*a* and the other side of the second ceramic substrate 110*b*, and thus bonds the first ceramic substrate 110*a* and the second ceramic substrate 110*b* as a whole. The bonding layer 155 may be formed of a polymer, by way of example, and the polymer may include a polymer sheet, by way of example. Permittivity of the bonding layer 155 may be lower than permittivity of the first ceramic substrate 110*a* and the second ceramic substrate 110*b*. As an example, permittivity of the bonding layer 155 may be 2 to 3 at 28 GHz. A thickness of the bonding layer 155 may be 50 μm to 200 μm.

According to an embodiment of the present disclosure, the first ceramic substrate 110*a* and the second ceramic substrate 110*b* are formed of a material having permittivity higher than that of the substrate 10, so a chip antenna module is miniaturized.

A material having permittivity lower than that of the first ceramic substrate 110*a* and the second ceramic substrate 110*b* is prepared between the first ceramic substrate 110*a* and the second ceramic substrate 110*b*, so overall permittivity of the chip antenna 100 is lowered. Thus, the radiation efficiency and gain may be improved.

Figure 6:
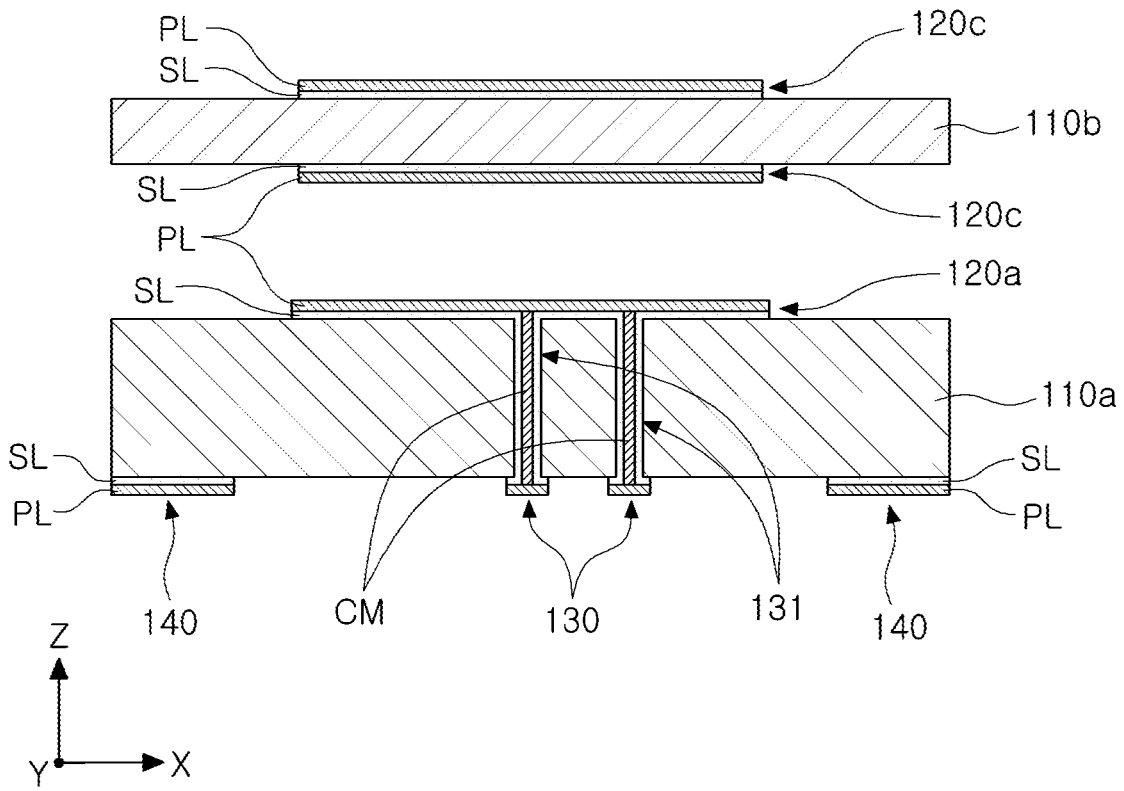
FIG. 6 is a partial cross-sectional view illustrating an example of a detailed configuration of a first patch antenna, a second patch antenna, a third patch antenna, a feed pad, a feed via, and a connection pad.

FIG. 6 is a partial cross-sectional view illustrating an example of a detailed configuration of a first patch antenna, a second patch antenna, a third patch antenna, a feed pad, a feed via, and a connection pad. In FIG. 6, the spacer 150 of an example and the bonding layer 155 of another example are omitted for convenience of description.

Referring to FIG. 6, a first patch antenna 120*a* may include a seed layer SL provided on one side of the first ceramic substrate 110*a* and a plating layer PL provided on the seed layer SL, each of a second patch antenna 120*b* and a third patch antenna 120*c* may include a seed layer SL and a plating layer PL, provided on the seed layer SL, and the seed layer SL and the plating layer PL may be provided on surfaces of the second ceramic substrate 110*b*.

The feed via 131 may include a seed layer SL formed along an internal wall of a via hole passing through the first ceramic substrate 110*a* in a thickness direction and a conductive material CM provided in the seed layer SL, and provided in the form surrounded by the seed layer SL, for example, a conductive paste. The conductive material CM may be formed in the entirety of an internal space surrounded by the seed layer SL. The conductive material CM is provided in a central region of a via hole, and the seed layer SL is connected to the conductive material CM, to be provided in an edge region of the via hole.

The feed pad 130 may include a seed layer SL provided on the other side of the first ceramic substrate 110*a* and a plating layer PL provided on the seed layer SL. Moreover, the connection pad 140 may include a seed layer SL provided on a ceramic substrate and a plating layer PL provided on the seed layer SL.

The seed layer SL of the first patch antenna 120*a* is connected to the seed layer SL of the feed via 131, while the seed layer SL of the feed pad 130 is connected to the seed layer SL of the feed via 131. Thus, the seed layer SL of the first patch antenna 120*a* formed in the first ceramic substrate 110*a* and the seed layer SL of the feed pad 130 may be connected to each other through the seed layer SL of the feed via 131.

The seed layers SL of the first patch antenna 120*a*, the second patch antenna 120*b*, the third patch antenna 120*c*, the feed pad 130, the feed via 131, and the connection pad 140 may be formed of the same material.

The seed layer SL may be formed of one type selected from Ti, Mo, and Cu, or may be formed of an alloy formed of two or more types. The plating layer PL may be formed of one type selected from Cu, Ni, and Sn, or may be formed of an alloy formed of two or more types. The seed layer SL may be formed using a sputtering process, while the plating layer PL may be formed using an electroplating process.

The seed layer SL of the feed via 131 is connected to the seed layer SL of the first patch antenna 120*a* and the seed layer SL of the feed pad 130, and thus may be integrally provided. In addition, the conductive material CM of the feed via 131 is provided in the form passing through the seed layer SL of the first patch antenna 120*a* and the seed layer SL of the feed pad 130 in a thickness direction, and thus may be directly connected to the seed layer SL/the plating layer PL of the first patch antenna 120*a* and the seed layer SL/the plating layer PL of the feed pad 130.

According to an embodiment of the present disclosure, the first patch antenna 120*a*, the second patch antenna 120*b*, the third patch antenna 120*c*, the feed pad 130, and the connection pad 140 include a seed layer SL with strong adhesion to a ceramic substrate. Thus, adhesion properties of the first patch antenna 120*a*, the second patch antenna 120*b*, the third patch antenna 120*c*, the feed pad 130, and the connection pad 140 against external impact, and the like may be improved.

Moreover, according to an embodiment of the present disclosure, the feed via 131 includes the seed layer SL formed using the same process as that of the seed layers SL of the first patch antenna 120*a* and the feed pad 130. Thus, even when a phenomenon occurs, in which a via hole is partially not filled with a conductive material CM, the feed via 131, the first patch antenna 120*a*, and the feed pad 130 may be stable connected to each other. Thus, conduction characteristics of the feed via 131 are secured, so a stable operation of a chip antenna may be guaranteed.

Figure 7A:
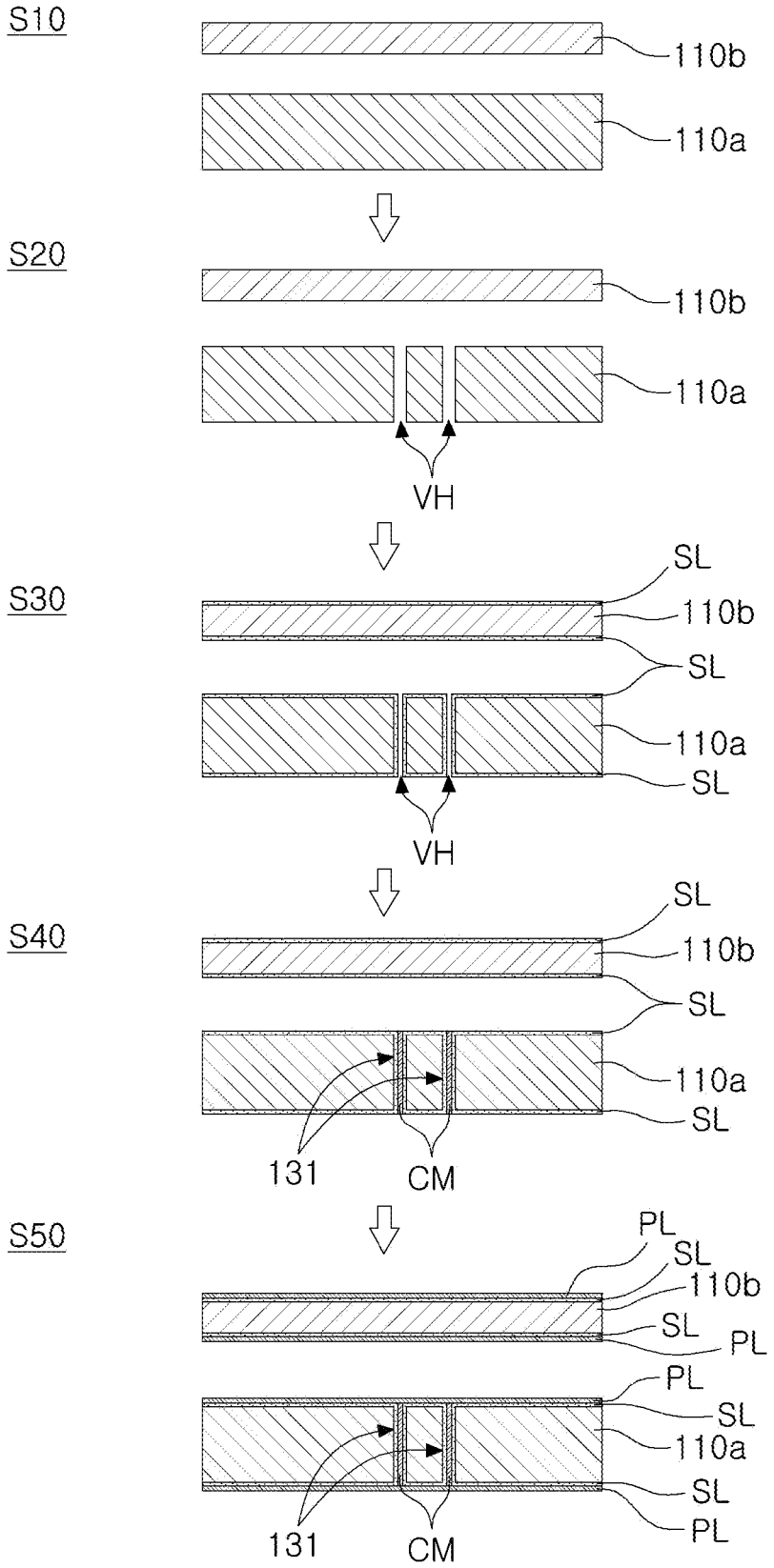
FIGS. 7A and 7B illustrate a schematic manufacturing flowchart of an example of a method of manufacturing a chip antenna.
Figure 7B:
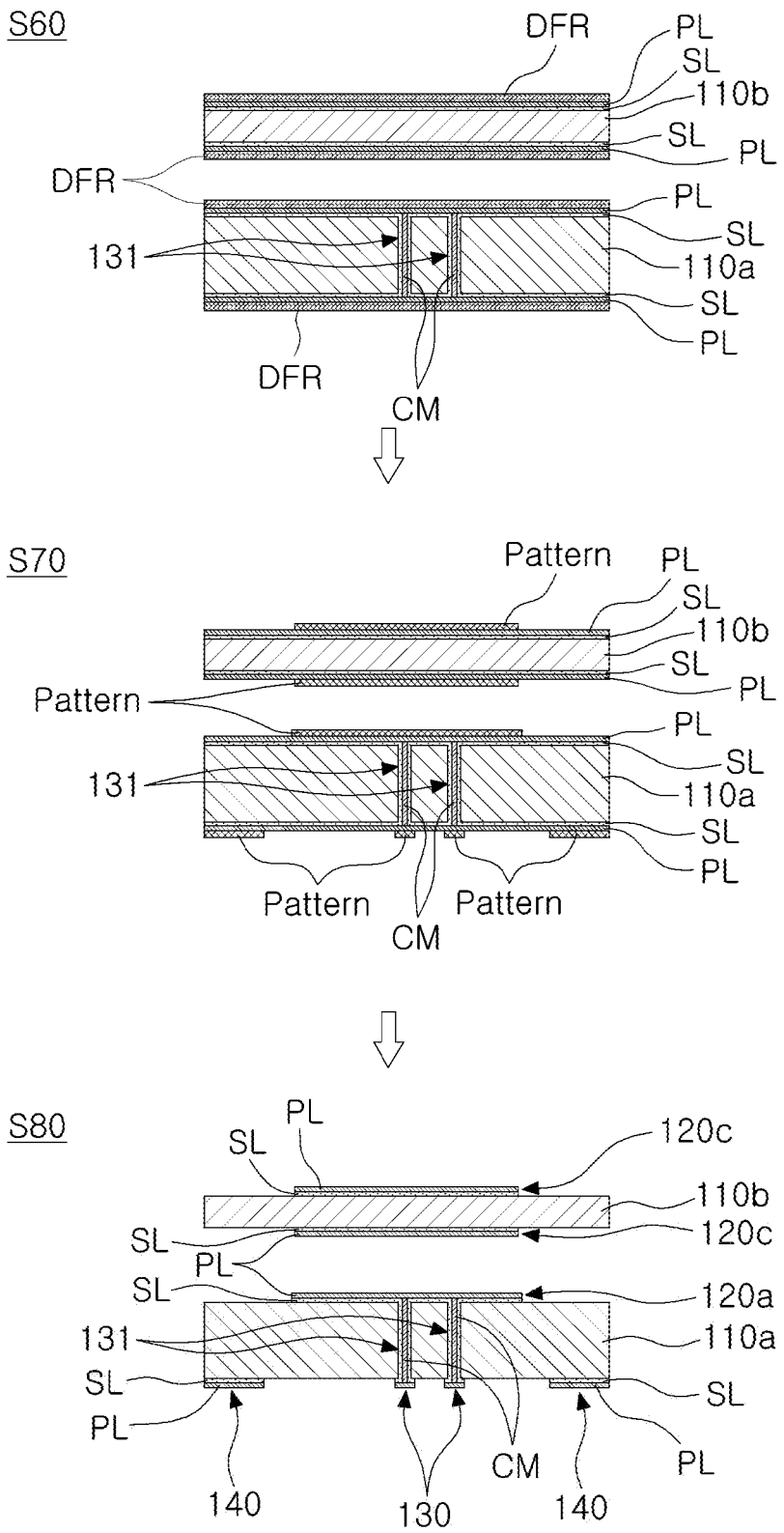

FIGS. 7A and 7B illustrate a schematic manufacturing flowchart of a method of manufacturing a chip antenna according to an example and another example of the present disclosure.

Referring to FIG. 7A, a first ceramic substrate 110*a* and a second ceramic substrate 110*b* are provided (S10), and a via hole VH passing through the first ceramic substrate 110*a* in a thickness direction is formed (S20).

Then, a seed layer SL is formed in surfaces of the first ceramic substrate 110*a*, surfaces of the second ceramic substrate 110*b*, and an inner wall of the via hole VH (S30), and a conductive material CM is formed in the seed layer SL formed in the via hole VH (S40). The seed layer SL is formed using a sputtering process, and the conductive material CM is formed using a paste fill process. The seed layers SL of the first ceramic substrate 110*a* and the second ceramic substrate 110*b* are formed using the same process. Thus, thicknesses of the seed layers SL in one side and the other side of the first ceramic substrate 110*a*, one side and the other side of the second ceramic substrate 110*b*, and an inner wall of the via hole VH may all be the same.

The conductive material CM may be extended toward seed layers SL formed on one side and the other side of the first ceramic substrate 110*a*, so an end portion may be exposed externally, in one side and the other side of the first ceramic substrate 110*a*. Due to the seed layer SL and the conductive material CM provided inside the via hole VH, a feed via 131 may be provided.

A plating layer PL is formed on seed layers SL on one side and the other side of the first ceramic substrate 110*a* and seed layers SL on one side and the other side of the second ceramic substrate 110*b* (S50). The plating layer PL may be formed using an electroplating process.

The plating layer PL, formed on seed layers SL on one side and the other side of the first ceramic substrate 110*a*, may be connected to the conductive material CM having an end portion exposed externally, on one side and the other side of the first ceramic substrate 110*a*.

Referring to FIG. 7B, photosensitive films DFR are stacked on plating layers PL opposing surfaces of the first ceramic substrate 110*a* and opposing surfaces of the second ceramic substrate 110*b* (S60).

The photosensitive films DFR provided above one side and the other side of the first ceramic substrate 110*a* and the photosensitive films DFR provided above one side and the other side of the second ceramic substrate 110*b* are exposed and developed to form a pattern (S70).

According to the pattern, the seed layer SL/the plating layer PL provided above one side, and the other side of the first ceramic substrate 110*a* and the seed layer SL/the plating layer PL provided above one side and the other side of the second ceramic substrate 110*b* are etched, and the pattern is peeled off, to form the first patch antenna 120*a*, the second patch antenna 120*b*, the third patch antenna 120*c*, the feed pad 130, and the connection pad 140 (S80).

Then, a spacer 150 is disposed between the first ceramic substrate 110*a* and the second ceramic substrate 110*b*, to manufacture a chip antenna according to an example. Moreover, the first ceramic substrate 110*a* and the second ceramic substrate 110*b* are bonded using a bonding layer 155, to manufacture a chip antenna according to another example.

Figure 8:
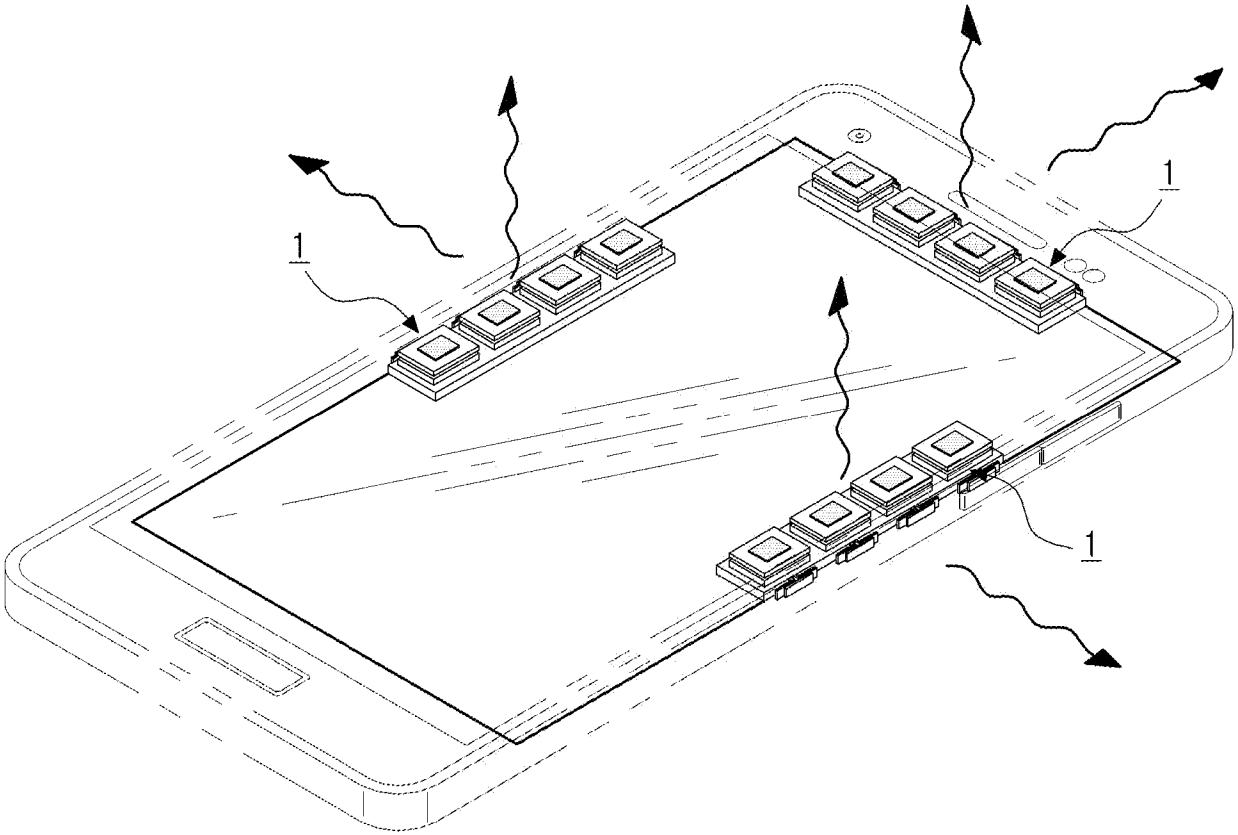
FIG. 8 is a schematic perspective view illustrating an example of a mobile terminal with a chip antenna module mounted therein.

FIG. 8 is a schematic perspective view illustrating an example of a mobile terminal with a chip antenna module mounted therein.

Referring to FIG. 8, a chip antenna module 1 in an embodiment is disposed adjacent to an edge of a mobile terminal. As an example, chip antenna modules 1 are disposed on opposing peripheral sides in a lengthwise direction or widthwise direction. In an embodiment, the case in which chip antenna modules that are disposed on opposing peripheral sides in a lengthwise direction and a side in a widthwise direction, of a mobile terminal, is described, by way of example, but an embodiment is not limited thereto. If an internal space of the mobile terminal is insufficient, two-chip antenna modules may be only disposed in a diagonal direction of the mobile terminal. As described above, the arrangement structure of a chip antenna module may be modified in various forms as needed. An RF signal, radiated through a chip antenna of the chip antenna module 1, is radiated in a thickness direction of a mobile terminal, while an RF signal, radiated through an end-fire antenna of the chip antenna module 1, may be radiated in a direction perpendicular to a side in a lengthwise direction or a side in a width direction, of a mobile terminal.

As set forth above, according to an embodiment in the present disclosure, a chip antenna may secure robust durability against an external impact by strengthening adhesion between a ceramic substrate and a patch antenna, and the like.

Moreover, a chip antenna according to an embodiment of the present disclosure may secure stable operation of a chip antenna by improving the conduction characteristics of a feed via.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna, comprising:

a first ceramic substrate;

a second ceramic substrate disposed to oppose the first ceramic substrate;

a first patch antenna including a seed layer, disposed on a surface of the first ceramic substrate, and a plating layer disposed on the seed layer;

a second patch antenna disposed on the second ceramic substrate; and a feed via including a seed layer, formed along an internal wall of a via hole penetrating through the first ceramic substrate in a thickness direction, and a conductive material surrounded by the seed layer in the via hole, wherein the seed layer of the first patch antenna and the seed layer of the feed via are connected to each other.

2. The chip antenna of claim 1, wherein the conductive material penetrates through the seed layer of the first patch antenna, and is connected to the plating layer of the first patch antenna.

3. The chip antenna of claim 1, wherein the seed layer of the first patch antenna and the seed layer of the feed via are formed of a same material.

4. The chip antenna of claim 1, wherein each of the seed layer of the first patch antenna and the seed layer of the feed via is formed of any one or any combination of any two or more of Ti, Mo, and Cu.

5. The chip antenna of claim 1, wherein the plating layer of the first patch antenna is formed of any one or any combination of any two or more of Cu, Ni, and Sn.

6. The chip antenna of claim 1, further comprising: a feed pad including a seed layer formed on another surface of the first ceramic substrate and a plating layer formed on the seed layer.

7. The chip antenna of claim 6, wherein the seed layer of the feed pad and the seed layer of the feed via are connected to each other.

8. The chip antenna of claim 7, wherein the conductive material penetrates through the seed layer of the feed pad, and is connected to the plating layer of the feed pad.

9. The chip antenna of claim 1, wherein a thickness of the seed layer of the first patch antenna disposed on the surface of the first ceramic substrate is equal to a thickness of the seed layer of the feed via formed on the internal wall of the via hole.

10. The chip antenna of claim 1, wherein an area of the second patch antenna is less than or equal to an area of the first patch antenna.

11. The chip antenna of claim 1, wherein the second patch antenna is electromagnetically coupled with the first patch antenna.

12. The chip antenna of claim 1, wherein the seed layer is formed with a sputtering process, and the conductive material is formed with a paste fill process.

13. A chip antenna, comprising:

a first ceramic substrate;

a second ceramic substrate disposed to oppose the first ceramic substrate;

a first patch antenna including a seed layer, disposed on a surface of the first ceramic substrate, and a plating layer disposed on the seed layer;

a second patch antenna disposed on the second ceramic substrate; and a feed via including a conductive material, disposed in a central region of a via hole penetrating through the first ceramic substrate in a thickness direction, and a seed layer, disposed in an edge region of the via hole, connected to the conductive material, wherein the conductive material is connected to the seed layer of the first patch antenna and the plating layer of the first patch antenna.

14. The chip antenna of claim 13, wherein the seed layer of the first patch antenna and the seed layer of the feed via are formed of a same material.

15. The chip antenna of claim 13, wherein each of the seed layer of the first patch antenna and the seed layer of the feed via is formed of any one or any combination of any two or more of Ti, Mo, and Cu.

16. The chip antenna of claim 13, wherein the plating layer of the first patch antenna is formed of any one or any combination of any two or more of Cu, Ni, and Sn.

17. The chip antenna of claim 13, wherein a feed pad includes a seed layer formed on another surface of the first ceramic substrate and a plating layer formed on the seed layer.

18. The chip antenna of claim 17, wherein the conductive material is connected to the seed layer of the feed pad and the plating layer of the feed pad.

19. The chip antenna of claim 13, wherein a thickness of the seed layer of the first patch antenna provided on the surface of the first ceramic substrate is equal to a thickness of the seed layer of the feed via formed on an internal wall of the via hole.

20. A chip antenna, comprising:

a first ceramic substrate having a first patch antenna disposed thereon;

a second ceramic substrate, disposed on and spaced apart from the first ceramic substrate, having a second patch antenna disposed thereon;

a feed via comprising a conductive material disposed in a via hole penetrating through the first ceramic substrate in a thickness direction; and a seed layer disposed between surfaces of the first ceramic substrate and the first patch antenna, and surfaces of the first ceramic substrate and the conductive material.

21. The chip antenna of claim 20, wherein the seed layer is formed along an internal wall of the via hole.

22. The chip antenna of claim 20, wherein the first patch antenna and the second patch antenna each comprises a plating layer disposed on the seed layer.

23. The chip antenna of claim 22, wherein the conductive material penetrates through the seed layer between the first patch antenna and first ceramic substrate, and is connected to the plating layer of the first patch antenna.

24. The chip antenna of claim 20, wherein the second ceramic substrate is spaced apart from the first ceramic substrate by a bonding layer or a spacer.

* * * * *